United States Patent [19]

Hadjiskakis et al.

[11] Patent Number: 4,585,510

[45] Date of Patent: Apr. 29, 1986

[54] FUSING MACHINE

[75] Inventors: Constantin Hadjiskakis, Nutley, N.J.; Mario Monoco, 4 Sand Rd., Fairfield, N.J. 07006

[73] Assignee: Mario Monaco, Fairfield, N.J.

[21] Appl. No.: 416,624

[22] Filed: Sep. 10, 1982

[51] Int. Cl.[4] ..... B31F 5/00

[52] U.S. Cl. ..... 156/555; 38/8; 38/10

[58] Field of Search ..... 38/7–11; 156/499, 555, 389; 198/813, 837, 840, 841; 118/261, 70, 104, 203, 204

[56] References Cited

U.S. PATENT DOCUMENTS

| | | | |
|---|---|---|---|
| 278,049 | 5/1883 | Ross . | |
| 284,723 | 9/1883 | Colahan . | |
| 293,383 | 2/1884 | Wagner . | |
| 440,292 | 11/1890 | Wiles . | |
| 1,000,974 | 8/1911 | Anderson . | |
| 1,179,217 | 4/1916 | Ramm . | |
| 1,347,121 | 7/1920 | Rice | 198/813 |
| 1,354,871 | 10/1920 | Asher . | |
| 1,664,229 | 3/1928 | Staege . | |
| 1,692,832 | 11/1928 | Harrison . | |
| 1,821,664 | 9/1931 | Peiler . | |
| 1,896,150 | 2/1933 | Zademach | 198/840 X |
| 2,270,000 | 1/1942 | Danker | 198/813 |
| 2,294,962 | 9/1942 | Cassell | 198/202 |
| 2,355,448 | 8/1944 | Kraty | 198/837 |
| 2,375,065 | 5/1945 | Askue | 198/202 |
| 2,540,862 | 2/1951 | Buser | 198/202 |
| 2,568,451 | 9/1951 | Kahl | 38/11 |
| 2,750,805 | 6/1956 | Winkel | 198/841 |
| 2,983,636 | 5/1961 | Runton | 154/52.1 |
| 3,223,027 | 12/1965 | Soda et al. | 100/93 |
| 3,309,983 | 3/1967 | Dresser | 100/93 |
| 3,434,901 | 3/1969 | Griffiths et al. | 156/210 |
| 3,487,566 | 1/1970 | Bravetti | 38/8 |
| 3,547,742 | 2/1970 | Cottrell | 156/583 |
| 3,595,377 | 7/1971 | McCoy et al. | 198/840 |
| 3,598,684 | 8/1971 | Militana et al. | 156/573 |
| 3,642,119 | 2/1972 | Warwick | 198/184 |
| 3,646,880 | 3/1972 | Norris | 99/349 |
| 3,690,981 | 9/1972 | DiFrank et al. | 156/210 |
| 3,767,511 | 10/1973 | Slade | 156/499 |
| 3,781,107 | 12/1973 | Ruhland | 355/15 |
| 3,847,480 | 11/1974 | Fisher | 355/15 |
| 3,890,193 | 6/1975 | Cartabbia | 156/582 |
| 3,923,583 | 12/1975 | Bianchini | 156/378 |
| 3,962,012 | 6/1976 | Schumacher | 156/164 |
| 3,999,649 | 12/1976 | Andersson | 198/499 |
| 4,114,228 | 9/1978 | Brown | 15/256.51 |
| 4,195,499 | 4/1980 | Yost | 68/5 |
| 4,202,437 | 5/1980 | Gordon | 198/497 |
| 4,206,528 | 6/1980 | Klemz | 15/256.51 |
| 4,241,691 | 12/1980 | Hopfe et al. | 118/126 |
| 4,249,650 | 2/1981 | Stahura | 198/499 |
| 4,255,227 | 3/1981 | Hill | 156/555 |
| 4,259,143 | 3/1981 | Giulie et al. | 156/499 |
| 4,328,888 | 5/1982 | Luke | 198/499 |
| 4,378,645 | 4/1983 | Allen | 38/8 |
| 4,411,082 | 10/1983 | Ferrage | 38/9 |

OTHER PUBLICATIONS

Reliant Fusing Machines "Maintenance and Instruction Manual".

Taconic Plastics Inc. brochure "TFE-GLASS".

Laughtomatic Sales Co., Inc. advertisement, Sep. 1981 issue (p. 244) of "Bobbin".

Kannegiesser advertisement, Sep. 1981 issue (p. 209) of "Bobbin".

One page advertisement for Simplex Model 245–246.

One page advertisement for Simplex Model 226.

One page advertisement for Simplex Model 228.

One page advertisement for Simplex Model 162.

One page advertisement for Simplex Model 163 and 14 page description.

*Primary Examiner*—David Simmons

*Attorney, Agent, or Firm*—Amster, Rothstein and Ebenstein

[57] ABSTRACT

An improved fusing machine is disclosed. Improved conveyor apparatus, conveyor belt guide apparatus, conveyor belt cleaning apparatus and oven apparatus are additionally disclosed, one or more of which can be utilized in a fusing machine. The preferred fusing machine is a return-to-operator machine in which feed and discharge conveyors for the oven are superposed, at least the upper conveyor preferably being transparent. The disclosed conveyor apparatus includes direction reversing apparatus, apparatus for adjusting the length of a conveyor and conveyor apparatus in which articles are resiliently engaged between and transported by opposed conveyor belt surfaces. A disclosed oven apparatus comprises resilient heating apparatus.

70 Claims, 30 Drawing Figures

FUSING MACHINE

BACKGROUND OF THE INVENTION

The present invention relates generally to apparatus for applying heat and pressure to generally flat or sheet-like articles such as fabric and backing pieces, and to oven apparatus, conveyor apparatus and guide apparatus therefor, and apparatus for cleaning moving surfaces such as rollers and conveyor belts. More particularly, the present invention relates to a fusing machine.

A fusing machine as known in the garment industry applies heat and pressure to two or more superposed pieces of fabrics, backing materials, laminates, etc. to adhere or fuse them together. Typically, the fused or adhered pieces provide rigidity or reinforcement to parts of garments such as fronts, cuffs, collars, pockets, etc.

Known fusing machines include both the in-line type and the return-to-operator type. Pieces are fed to an in-line machine from one side of the machine and are discharged from the other side of the machine, as for example, in the machine described in U.S. Pat. No. 3,767,511. Typically a feed conveyor is disposed on one side of the machine to feed pieces to an oven in which the pieces are heated and pressure is applied to fuse the pieces, and either a discharge conveyor or a tray are disposed at the other side of the machine to receive fused pieces discharged from the oven. Known in-line fusing machines generally require a relatively large amount of floor space and utilize relatively large and energy inefficient ovens. In-line machines are known to utilize an opposed belt-type oven in which the pieces are engaged between two belts, or a drum-type oven in which the pieces are engaged between a drum and a belt or roller, or between two drums. Known return-to-operator machines typically use a drum-type oven.

Known ovens suffer from several drawbacks. The opposed belt-type ovens are usually quite large and poorly insulated, and therefore require a great deal of energy to heat. Moreover, some belt-type ovens apply heat by means of a large metal platen which requires a great deal of energy to heat. The drum-type ovens apply heat through a drum which is typically large and also requires a great deal of energy to heat.

Many known fusing machines also experience difficulties in maintaining the oven surfaces, i.e. drum, roller or belt surfaces, clean. For example, apparatus provided for cleaning those surfaces itself has to be periodically cleaned and heretofore necessitated shutting down the machine. Additionally, prior machines could not continue to operate if the oven surfaces were not clean. Thus, if an oven surface became thickened with accumulations, a residue or a piece of fabric or backing adhered to a drum or belt surface, the machine had to immediately be shut down to clean the belt or drum since the pressure part of the oven could not accommodate the increase in belt or drum surface height due to the accumulations, etc.

In belt-type ovens, the belt is typically driven by tensioning it around several rollers at least one of which was driven. Such an arrangement has required belt guidance apparatus to insure that the belt remains aligned on the drive roller. Some known guide apparatus axially moved one of the rollers or cylinders by a hydraulic or pneumatic system so as to maintain the belt aligned.

Many prior fusing machines, whether of the in-line or return-to-operator type, or using belt or drum-type ovens, utilize expensive penumatic or hydraulic systems for applying pressure to the pieces and/or for guiding the belts of feed, discharge and oven conveyors.

Thus, many prior fusing machines are inefficient and/or utilize complicated systems which have to be monitored relatively frequently and require maintenance or repair relatively often.

The present invention provides an improved fusing machine in which the drawbacks mentioned above are eliminated, and improved fusing machine subassemblies, as well as improved heat and pressure applying apparatus, improved oven apparatus, improved conveyor apparatus and guide apparatus therefor, improved apparatus for cleaning moving surfaces and other improved apparatus.

OBJECTS AND SUMMARY OF THE INVENTION

It is an object of the present invention to provide energy efficient heat and pressure applying apparatus, particularly a fusing machine.

It is another object of the present invention to provide heat and pressure applying apparatus, particularly a fusing machine, which is substantially maintenance free.

It is another object of the present invention to provide heat and pressure applying apparatus, particularly a fusing machine, requiring less floor space.

It is another object of the present invention to reduce the number of personnel required to operate heat and pressure applying apparatus, particularly a fusing machine.

It is another object of the present invention to provide heat and pressure applying apparatus, particularly a fusing machine, which does not utilize hydraulics or pneumatics.

It is another object of the present invention to provide pressure applying apparatus which does not utilize hydraulics or pneumatics to apply the pressure, particularly for apparatus in which heat is also supplied, for example in a fusing machine.

It is another object of the present invention to facilitate feeding of articles to and removal of articles from heat and pressure applying apparatus, particularly a fusing machine.

It is another object of the present invention to provide improved return-to-operator heat and pressure applying apparatus, particularly a fusing machine.

It is another object of the present invention to provide apparatus for converting in-line heat and pressure applying apparatus, particularly a fusing machine, to a return-to-operator machine.

It is another object of the present invention to provide conveyor apparatus for reversing the direction of travel of flat articles such as fabric pieces, particularly for heat and pressure applying apparatus, for example a fusing machine.

It is another object of the present invention to provide improved heat and pressure applying apparatus, particularly for a fusing machine.

It is another object of the present invention to provide an oven of reduced size, particularly for a fusing machine.

It is another object of the present invention to improve the energy utilization of an oven, particularly for a fusing machine.

It is another object of the present invention to provide improved conveyor apparatus, particularly for heat and pressure applying apparatus, for example a fusing machine.

It is another object of the present invention to provide improved guide apparatus for a flat moving surface such as a conveyor belt, particularly for heat and pressure applying apparatus, for example a fusing machine.

It is another object of the present invention to provide guide apparatus for a moving flat surface which does not include hydraulics or pneumatics.

It is another object of the present invention to provide improved apparatus for cleaning a moving surface such as a conveyor belt or roller, particularly for heat and pressure applying apparatus, for example a fusing machine.

It is another object of the present invention to provide such apparatus for cleaning a moving surface which itself can be cleaned without shutting down the moving surface it is cleaning.

It is another object of the present invention to adjust the length of a conveyor while utilizing a single size or different size belts.

The above and other objects are achieved by the invention disclosed herein.

The invention in one of its aspects provides a machine for applying heat and pressure to flat articles such as fabric pieces of sheets in which substantially superposed means automatically feed and remove articles from a heat and pressure applying apparatus. Fabric pieces or sheets are meant to include natural or synthetic fabric pieces or non-fabric pieces such as natural or synthetic rubber or plastics, or backing material, such as plastic sheets or laminates which are adhered to, or are to be adhered to, a fabric piece. Such a machine which can be a fusing machine for joining fabric pieces to backing material comprises heat and pressure applying apparatus including an entrance disposed for receiving flat articles delivered to the apparatus in a direction which is transverse to the vertical and an exit vertically spaced from the entrance for discharging the articles in a direction transverse to the vertical. Means are disposed for automatically delivering articles to the entrance of the heat and pressure applying apparatus and means are disposed for automatically removing articles discharged from the exit of the heat and pressure applying apparatus. In a disclosed embodiment, the means for delivering comprises a feed conveyor having a moving surface extending generally in said direction transverse to the vertical, and the means for removing comprises a discharge conveyor having a moving conveyor surface extending generally in said direction transverse to the vertical and is disposed substantially in vertical alignment with the moving surface of the feed conveyor. The heat and pressure applying apparatus moves the articles vertically along a path which extends in a direction or directions transverse to the horizontal. In a preferred embodiment, the moving surfaces of the feed and discharge conveyors extend generally horizontally and the path through the heat and pressure applying apparatus extends generally vertically. Surface, as used herein, is meant to encompass an effective surface formed by spaced surfaces or a foraminous surface. For example, a moving conveyor surface can comprise spaced belts or cords, netting, etc.

According to another aspect of the invention, at least the upper of the moving surfaces of the feed and discharge conveyors is substantially transparent or the upper and lower conveyors are sufficiently spaced in order to facilitate the deposit and removal of articles on and off the conveyors. By transparent, it is meant that an operator can see through the conveyor surface. Thus, a transparent conveyor surface can be made of clear plastic, netting, can comprise spaced cords or belts, can be foraminous, etc.

The heat and pressure applying apparatus in accordance with an aspect of the invention can comprise a first conveyor comprising an entrance cylinder, an exit cylinder vertically spaced from the entrance cylinder and a movable conveyor surface such as an endless belt extending in a direction transverse to the horizontal and extending about the entrance cylinder and the exit cylinder, an engaging surface disposed adjacent and extending generally parallel to the movable conveyor surface, the movable conveyor surface cooperating with the engaging surface to engage articles therebetween and move articles engaged therebetween upon movement of the movable surface. The engaging surface can include an entrance portion forming an entrance nip facing in a direction transverse to the vertical in cooperation with the portion of the movable surface extending about the entrance cylinder, and an exit portion forming an exit nip facing in a direction transverse to the vertical in cooperation with the portion of the movable surface extending about the exit cylinder. Means such as an electric motor and an associated transmission are provided for moving the movable surface.

According to another aspect of the invention, support structure adjacent to the movable and/or engaging surface need not be provided. The movable and/or engaging surface can be tensioned and the surfaces made to engage by the action of nips formed by entrance and exit cylinders and by the path followed by the moving surface.

The first conveyor of the heat and pressure applying apparatus preferably includes support structure over which the movable surface is moved. According to an aspect of the invention, the support structure is flexible and can comprise, for example, a flexible sheet-like member. The engaging surface can also be supported by support structure which also can be flexible.

According to another aspect of the invention, a resilient, preferably flexible support structure is provided for the moving surface, or for the engaging surface, or for both. The resilient support stucture enable the fabric pieces to be lightly compressed between and resiliently engaged by the moving surface and the engaging surface.

The support structure for direction reversing apparatus can be offset from the axes of the entrance and exit cylinders away from the engaging surface and/or the cylinders positioned to cause the movable surface to follow a generally C-shaped, direction reversing path, the engaging surface being disposed between and generally aligned with the entrance and exit cylinders.

According to another embodiment, the engaging means is C-shaped and the first conveyor is disposed substantially within the engaging means.

According to a disclosed embodiment, the engaging surface is movable and can, for example, be another endless belt. For direction reversing apparatus, another entrance cylinder is disposed adjacent said entrance cylinder and another exit cylinder is disposed vertically spaced from said another entrance cylinder, adjacent said exit cylinder. The movable engaging surface extends about said another entrance cylinder and said another exit cylinder. A portion of the engaging surface which extends about said another entrance cylinder forms said entrance nip with a portion of said movable surface which extends about said another entrance cylinder. A portion of the engaging surface which extends about said another exit cylinder forms said exit nip with a portion of said movable surface which extends about said exit cylinder. The axes of the two entrance cylinders and the two exit cylinders are preferably disposed substantially in a common plane. The means for moving also preferably moves the engaging surface.

Such a cylinder arrangement can be used to provide tensioning and engaging of the belts without utilizing support structure adjacent the belts.

According to a disclosed embodiment, the movable conveyor surface and the movable engaging surface overall follow a substantially linear path between the entrance and exit cylinders. However, the actual path followed by the conveyor surface and the movable engaging surface may be somewhat arcuate or sinuous as the surfaces pass over support structure and/or heating means. Providing such an arcuate or sinuous path for the conveyor and movable surfaces assists in engaging pieces between the surfaces and transporting the pieces.

Pressure can be applied to the pieces as they pass between the entrance cylinders and/or as they pass between the exit cylinders. In a fusing machine, pressure is applied to the pieces as they pass between the exit cylinders and after they have been heated.

Heating means, which may for example comprise resistive heating elements, infrared heating apparatus, microwave heating apparatus, and hot fluid, e.g. air, heating apparatus, are disposed adjacent the moving surface and/or the engaging surface on the side thereof opposite to the other surface. The respective surface is operative to transmit heat to articles engaged between the moving surface and the engaging surface.

The heating means in accordance with an aspect of the invention may comprise support structure, preferably including a support surface, for the engaging and/or movable surface.

In accordance with one aspect of the invention, the heating means comprises a flexible member or members defining a flexible support surface. For example, the heating means can comprise a woven or silicone rubber encapsulated heating element. The heating means can also comprise a flexible member or members defining a support surface adjacent to which heating elements, hot fluids or infrared or microwave heating apparatus are disposed. It is also within the contemplation of the invention that the moving surface, the engaging surface or both be a heating element, for example a flexible heating element, or part of a heating means.

The support structure of the heating means in accordance with an aspect of the invention may be resilient or resiliently supported. For example, the heating support surface, which is preferably flexible, can be supported by fluid pressure or resilient material such as insulation, for example.

In order to apply pressure to the pieces as they pass through the entrance and/or the exit cylinders, either or both pairs of cylinders are urged together. Means are therefore provided for urging, preferably resiliently, either or both pairs of cylinders together. According to an aspect of the invention, such means for urging are preferably mechanical and do not include hydraulics or pneumatics. According to a disclosed embodiment, the entrance and exit cylinders of the first conveyor are supported in a first frame and the entrance and exit cylinders of the engaging surface are supported in a second frame, and said urging means urges one frame towards the other frame.

Preferably means are provided for pivotally connecting at least one of the two frames so that engaging and conveyor surfaces may be moved into and out of an engaging condition.

In accordance with another aspect of the invention in which the moving surface and/or the engaging surface are endless conveyor belts and either or both are driven, the belts are not tightly tensioned about cylinders or other structures in order to drive the belts. Rather, the driven belt or belts are relatively loosely disposed about cylinders or support structure including an exit for either or both belts, and the exit cylinder of one of the belts is driven and is pressed against either another exit cylinder, preferably driven also, or other structure to form a nip through which the belt or belts are drawn. This arrangement can be used to tension and engage the belts without utilizing support structure adjacent the belts.

As used herein, a conveyor belt or endless belt is meant in its broadest sense and can be of solid rubber, plastic or metal, or can be foraminous, e.g. screened or netted, or can be comprised of adjacently disposed cords, etc.

In accordance with an aspect of the invention, the heat and pressure applying apparatus can be utilized as a direction reversing conveyor. For example, such a direction reversing conveyor may be provided with one or more of the heating means described herein, the support structure described herein, the urging means described herein, and other features described herein, and can be supplied as an independent unit, part of a system or in kit form. For example, such a direction reversing conveyor can be supplied as a kit to convert in-line machines to return-to-operator machines.

In accordance with another aspect of the invention, the heat and pressure applying apparatus need not be of the direction reversing type and need not be disposed in a direction transverse to the horizontal. Thus, such heat and pressure applying apparatus can be disposed transverse to the vertical, for example generally horizontally, and can be used as the heat and pressure applying apparatus of an in-line machine or an in-line heating apparatus, an in-line pressure applying apparatus, or an in-line conveyor apparatus. Such in-line apparatus may be provided with one or more of the heating means described herein, the support structure described herein, the urging means described herein and other features described herein, and can be supplied as an independent unit, part of a system or in kit form.

According to another aspect of the invention, a guide is provided for a flat moving object, for example, a moving support surface such as a conveyor belt. For the sake of convenience, the guide will be described below with respect to a conveyor belt. Advantageously, the guide can be utilized in connection with one or more of the moving surfaces described above. The guide comprises means for guiding a belt substantially along the transverse extent thereof, first anti-friction means disposed adjacent a transverse edge of the belt for guiding the transverse edge of the belt in the direction of movement of the belt, and second anti-friction means disposed adjacent an opposed transverse edge of the belt for guiding the opposed transverse edge of the belt in the direction of movement of the belt. The anti-friction means disposed at each side of the belt can contact or guide the belt at one or more spaced locations in the direction of travel of the belt. The anti-friction means can comprise moving devices such as bearings or bushings, or simply low friction stationary surfaces. Respective guiding locations at opposed transverse edges of the belt are preferably substantially opposite each other relative to the direction of movement of the belt, thereby providing contacts on both sides of the belt which are oppositely disposed. The anti-friction means preferably provide point-type guiding contacts to the edges of the belt.

The guide thus does not utilize hydraulics or pneumatics and does not control any of the cylinders about which a belt moves. Moreover, the guide enables the return run of the belt to be loosely tensioned, particularly in cooperation with belts driven through a nip.

Preferably, the guide apparatus is disposed in a conveyor ahead, i.e. upstream, of a driven roller in the return run of the belt.

According to a disclosed embodiment, the anti-friction means comprises two roller-element bearings, for example ball bearings, each having a circular face adapted to contact the respective edge of the belt. Thus, low friction, substantially point contacts are provided.

The means for guiding can comprise a guide surface extending adjacent to the belt transversely thereof, or a spaced pair of guide surfaces between which the belt extends. The guide surface or surfaces can be flat or cylindrical. Preferably, means are provided for resiliently supporting a guide surface or coupling two guide surfaces together. Thus, a guide surface can resiliently move to allow a belt to pass between two guide surfaces even if there are accumulations or residues on the belt or an article stuck to the belt. As a result, the system utilizing the belt does not have to be immediately shut down should there be matter stuck to the belt. For the embodiment utilizing one or more cylindrical surfaces, one or more cylinders are provided at least one of which is rotatably mounted.

Advantageously, the guide is utilized with a conveyor of the heat and pressure applying apparatus described herein.

According to still another aspect of the invention, apparatus is provided for cleaning a moving surface such as a conveyor belt or a rotating cylinder. Advantageously, the cleaning apparatus can be used to clean one or more of the moving surfaces or cylinders described above. The cleaning apparatus comprises a first or primary doctor blade or scraper, a second or an auxiliary doctor blade or scraper, means for supporting the second doctor blade with an edge thereof extending transversely of the direction of movement of the moving surface adapted to doctor or scrape the moving surface at a first location, and means for supporting the first doctor blade with an edge thereof extending transversely of the direction of movement of the moving surface adapted to doctor or scrape the moving surface at a second location upstream of and adjacent to the first location. The means for supporting the first doctor blade enables the first doctor blade to be moved relatively easily relative to the moving surface and the second doctor blade while the second doctor blade remains stationary with its edge doctoring the moving surface at said first location. Thus, the first or primary doctor blade can be removed in order to clean, repair, or replace it, or to remove accumulated deposits, while the second or auxiliary doctor blade continues to doctor the moving surface. Means are provided for cleaning the first and/or second doctor blades as the first doctor blade is being removed. As a result, apparatus in which the moving surface is utilized need not be shut down while the first or primary docotor blade is cleaned or repaired.

In accordance with a disclosed embodiment, the edges of the first and second doctor blades are parallel and extend axially along the circumference of a cylinder to docotor a surface moving over or with the cylinder.

Means are provided for removably supporting the first doctor blade on the second doctor blade comprising cooperating structure on the two blades preferably such that the first doctor blade can only be moved relative to the second doctor blade in a direction parallel to the blade edges.

If desired, the second doctor blade can include a portion extending away from the blade edge so that the second doctor blade can be disposed between two cylinders to bridge the cylinders and form a ramp from one cylinder to the other. Thus, pieces on adjacent conveyor belts extending over adjacent cylinders can be moved from one belt to the other.

In accordance with another aspect of the invention, means are provided for adjusting the length or run of a conveyor. Such means enables the conveyor length to be adjusted using either the same or different size belts.

The above and other objects, aspects, features and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which:

FIG. 3 is a rear elevation view, partly broken away, of the fusing machine of FIG. 1;

FIG. 4 is a perspective rear view of the fusing machine of FIG. 1, partly broken away, depicting the heat and pressure applying apparatus of the machine in a hinged open condition;

FIG. 5 is a rear elevation view, partly broken away, of one embodiment of the heat and pressure-applying apparatus of the fusing machine of FIG. 1;

FIG. 6 is a schematic side elevation view of the heat and pressure-applying apparatus depicted in FIG. 5;

FIG. 28 is a side elevation view of a portion of a conveyor including apparatus for adjusting the length of the conveyor;

FIG. 29 is a top plan view of the portion of the conveyor depicted in FIG. 28; and FIG. 30 is a cross-section view taken along line 30—30 of FIG. 28.

DESCRIPTION OF THE PREFERRED EMBODIMENTS

Referring more particularly now to the drawings, embodiments of a fusing machine according to the invention and embodiments of sub-assemblies thereof and apparatus which can be used with a fusing or other machine are illustrated. Apparatus for converting an in-line fusing machine to a return-to-operator fusing machine is also illustrated.

Although the invention is described below with respect to fusing machines, the invention is applicable to other machines such as pre-shrinking, bonding, laminating, pressing (with or without steam), vulcanizing, heat-sealing, thermoplastic welding, coating machines, etc. The invention is also described below with respect to fusing of fabric pieces. However, the invention is applicable to applying heat and/or pressure to or transporting other articles whether in discrete pieces or fed from a roll. Moreover, although various sub-assembles and apparatus are described in connection with a fusing machine, such sub-assemblies and apparatus can be used in apparatus other than fusing machines. In addition, the apparatus described herein can be provided with one or more of the inventive features disclosed, or with different combinations of such features, whether for a fusing machine or other machine either of the in-line or direction reversing type.

Figure 1:
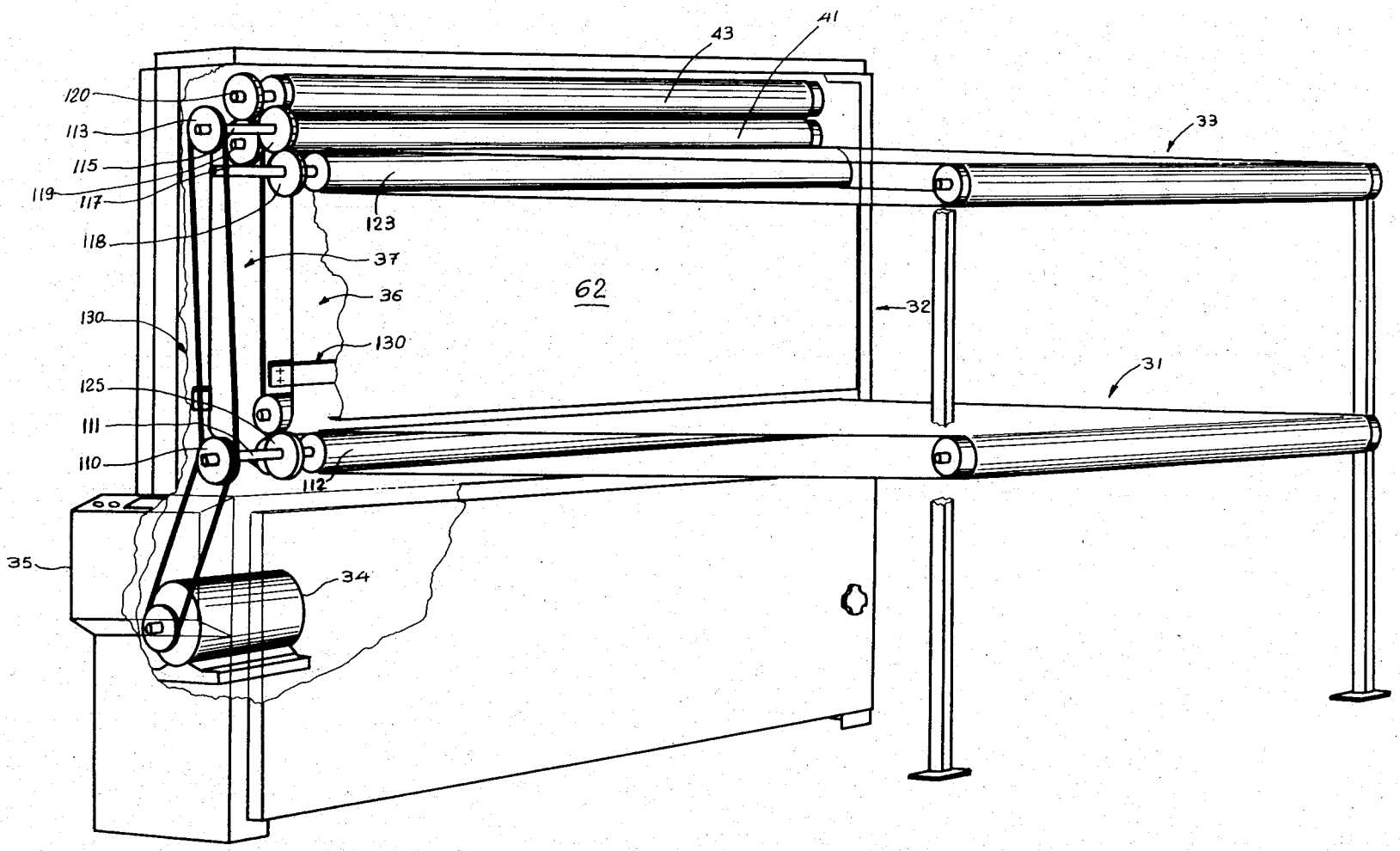
FIG. 1 is a perspective front view, partly broken away, of a fusing machine according to the invention.

Referring now to FIG. 1, a return-to-operator fusing machine is illustrated which comprises a feed belt conveyor 31, a heat and pressure-applying or oven apparatus 32, and a discharge belt conveyor 33. The fusing machine also includes a drive motor 33 and an associated transmission for the feed and discharge belt conveyors and belt conveyors in the oven 32, and control apparatus 35. The oven 30, the drive motor 34 and transmission, and the control apparatus 35 are mounted in a housing or frame.

The control apparatus 35 is conventional and includes means for controlling the speed of motor 34, and means for manually energizing and de-energizing the drive apparatus and for de-energizing the entire fusing machine under emergency conditions. The control apparatus 35 further includes means such as thermostats for regulating the temperature in the oven 32. The control apparatus also includes fuses and emergency circuit breakers. Means in accordance with the invention can also be provided to automatically switch off heating elements in the oven when the feed and/or discharge and/or oven conveyors are not being driven. The transmission according to the invention can include clutch means to disengage the drive from selected cylinders without switching motor 34 off.

Figure 2:
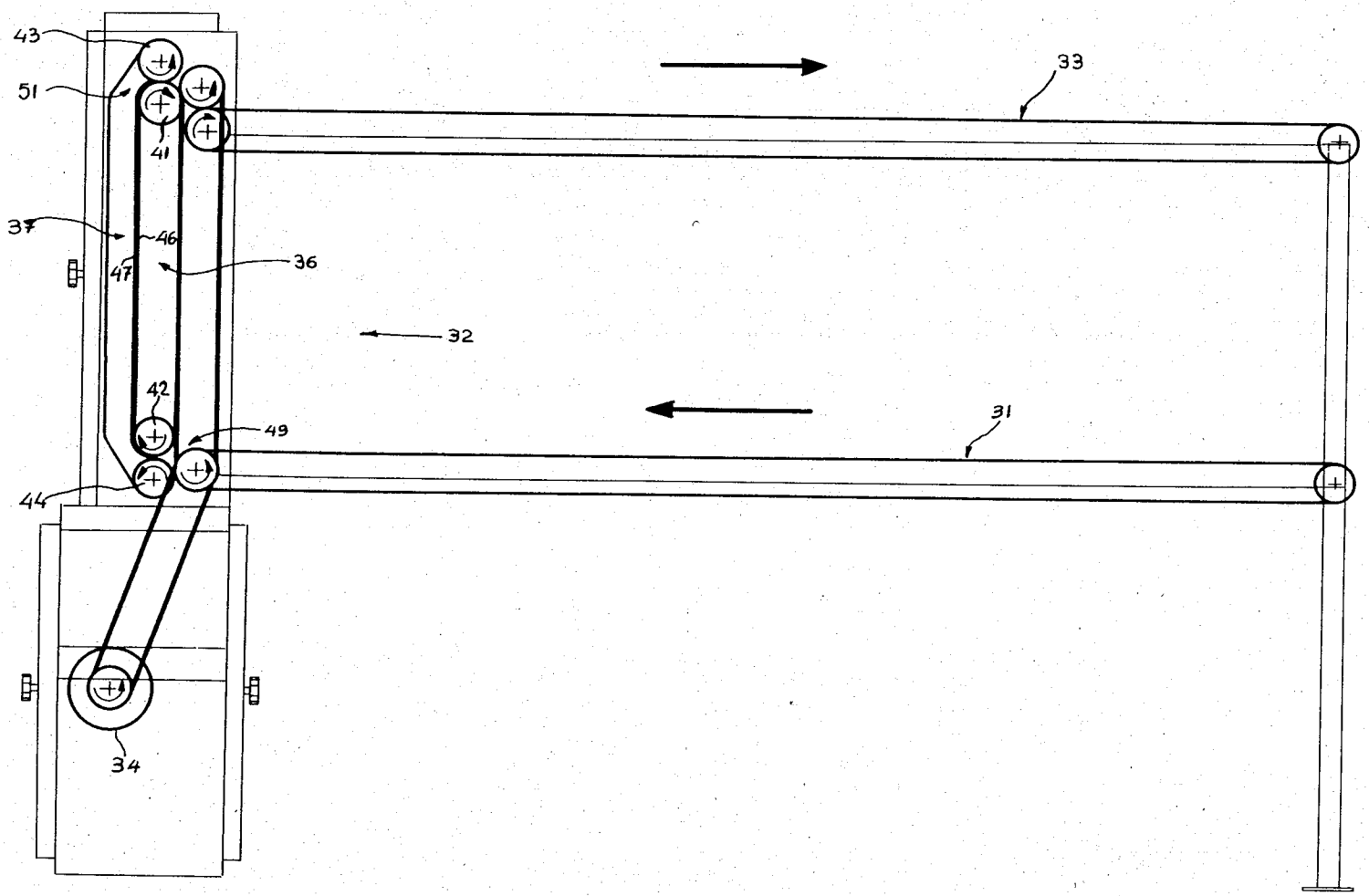
FIG. 2 is a schematic side elevation view of the fusing machine of FIG. 1.

Referring now to FIGS. 1–6, the oven 32 includes two adjacently disposed belt conveyors 36 and 37. As shown in FIG. 4, each conveyor comprises a frame 39, 40 and a pair of rollers or cylinders 41, 42 and 43, 44. Each pair of rollers for the respective conveyor is vertically spaced as depicted in FIG. 2 and an endless belt 46, 47 is mounted around a respective pair of rollers to rotate upon rotation of either or both respective pairs of rollers. Rollers 42 and 44 are adjacently disposed with their axes aligned in a generally vertically-extending plane such that the belt surfaces extending about rollers 42 and 44 and rotating with those rollers form a horizontally-facing entrance nip 49 to the oven. Roller 41 and 43 are also adjacently disposed with their axes aligned in a generally vertically-extending plane such that belt surfaces extending about rollers 41 and 43 and rotating with those rollers form a horizontally-facing exit nip 51 from the oven. All of rollers 41–44 are disposed with their axes extending in generally the same plane. Aligning the axes of all of rollers 41–44 in a common vertical plane provides vertical alignment of the entrance to and the exit from the oven, as shown in FIG. 2. The belts 46, 47 and the rollers 42, 44 are arranged to cooperate to receive articles 52 (FIG. 15) delivered to the entrance nip 49 of the oven from the feed conveyor 31, engage the articles and vertically transport them between the belts through the oven to the discharge nip 51, through which the articles are discharged from the oven onto the discharge conveyor 33

In order to change the direction of articles supplied horizontally to the entrance nip 49, the path of belt 47 as it leaves roller 44 (FIGS. 2 and 6) is changed from a horizontal to a vertical direction by following the contour of roller 42. A change of direction from the vertical to the horizontal is similarly obtained by the disposition of rollers 41 and 43.

The frames of conveyors 36 and 37 support belt support structure or surfaces disposed along the travel of the belts between the entrance and exit rollers of the respective conveyor.

In one embodiment depicted in FIGS. 5–10, the support structure comprise vertically-spaced, horizontally extending members 54 disposed vertically offset on opposing frames, i.e. in an alternating fashion from one frame to the other. The support members 54 overlap in or are closely spaced from a common vertical plane and can be said to define a support surface for each belt. This arrangement causes the belts, which are not tightly tensioned, to follow a slightly sinuous path (not shown). The sinuous path improves the engaging characteristics of the two belts in vertically transporting pieces between the belts.

Figure 8:
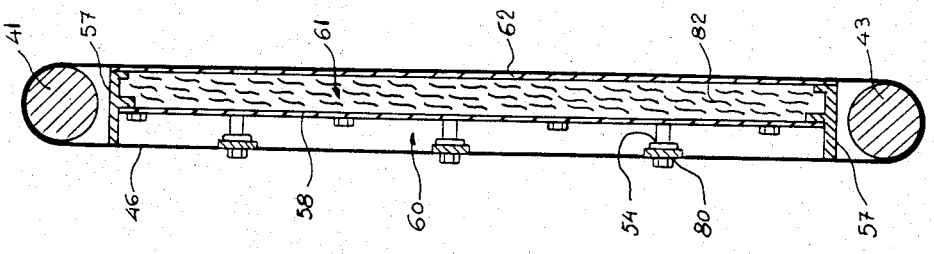
FIG. 8 is a cross-section view of the conveyor depicted in FIG. 7 taken along line 8—8 of FIG. 7.
Figure 7:
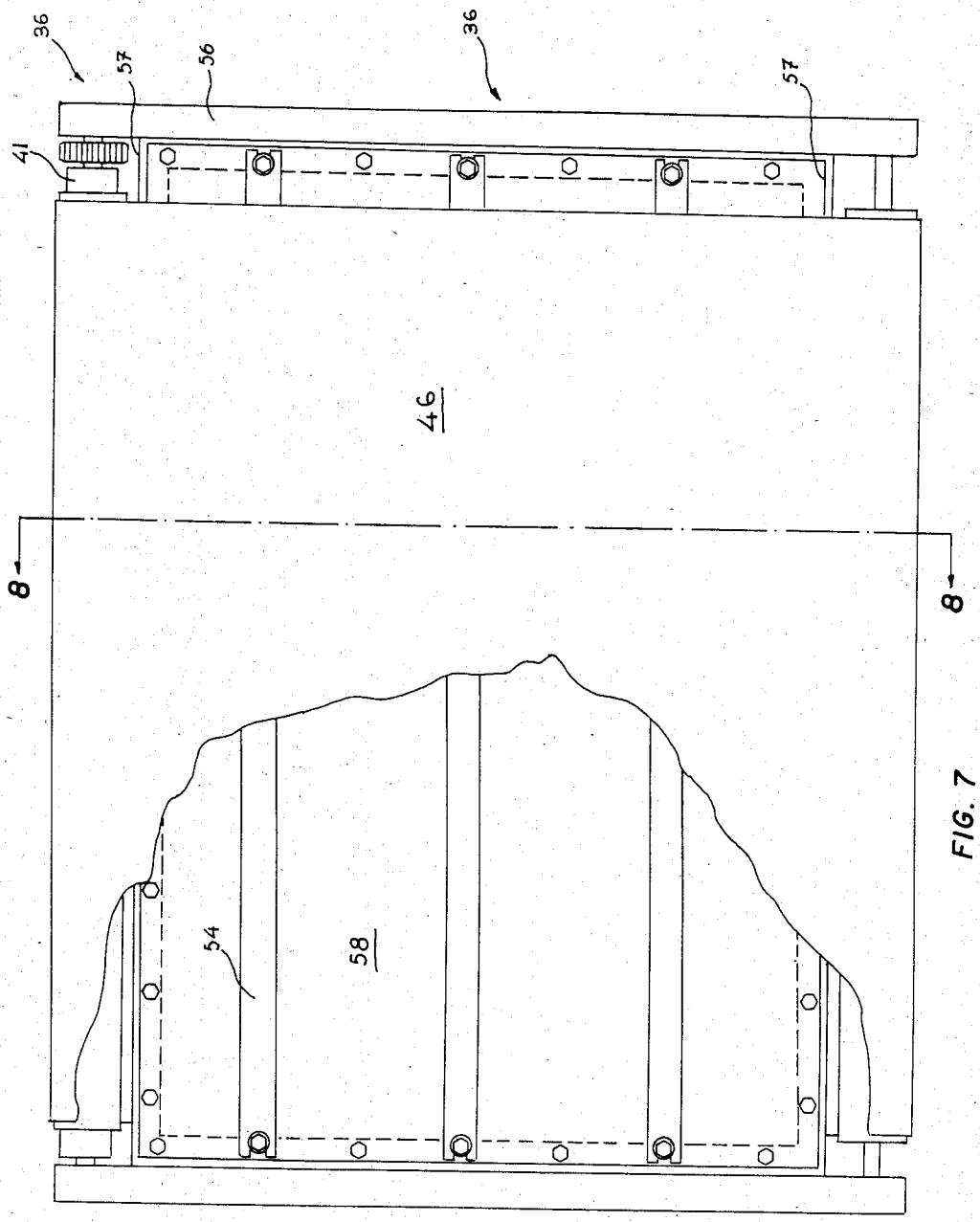
FIG. 7 is a front elevation view, partly broken away, of one conveyor of the heat and pressure applying apparatus depicted in FIGS. 5 and 6.

Referring now to FIGS. 7 and 8, frame 36 comprises a pair of spaced side brackets 56 and upper and lower brackets 57 connected together to form a frame. A metal sheet or panel 58 is secured to the side and upper and lower brackets, as by angles, centrally in the frame so as to separate the frame into two compartments, 60, 61. Compartment 61 is closed off by metal sheet or panel 62 for reasons which will be described below. The support members 54 are provided as metal strips or bars and are secured to the side brackets spaced from the metal sheet 58 on the side of sheet 58 facing frame 37, i.e. over compartment 60. The depth of the compartment and the spaces between the strips 54 enables the belts to somewhat enter compartment 60 and thereby provide the sinuous path described above. The upper and lower brackets 57 are formed as V-channels (FIG. 6) with the open side of the V facing away from the compartments, i.e. facing the entrance and exit rollers. The V-channels form a recess adjacent to the entrance and exit rollers and at the same time close off the compartments.

Figure 9:
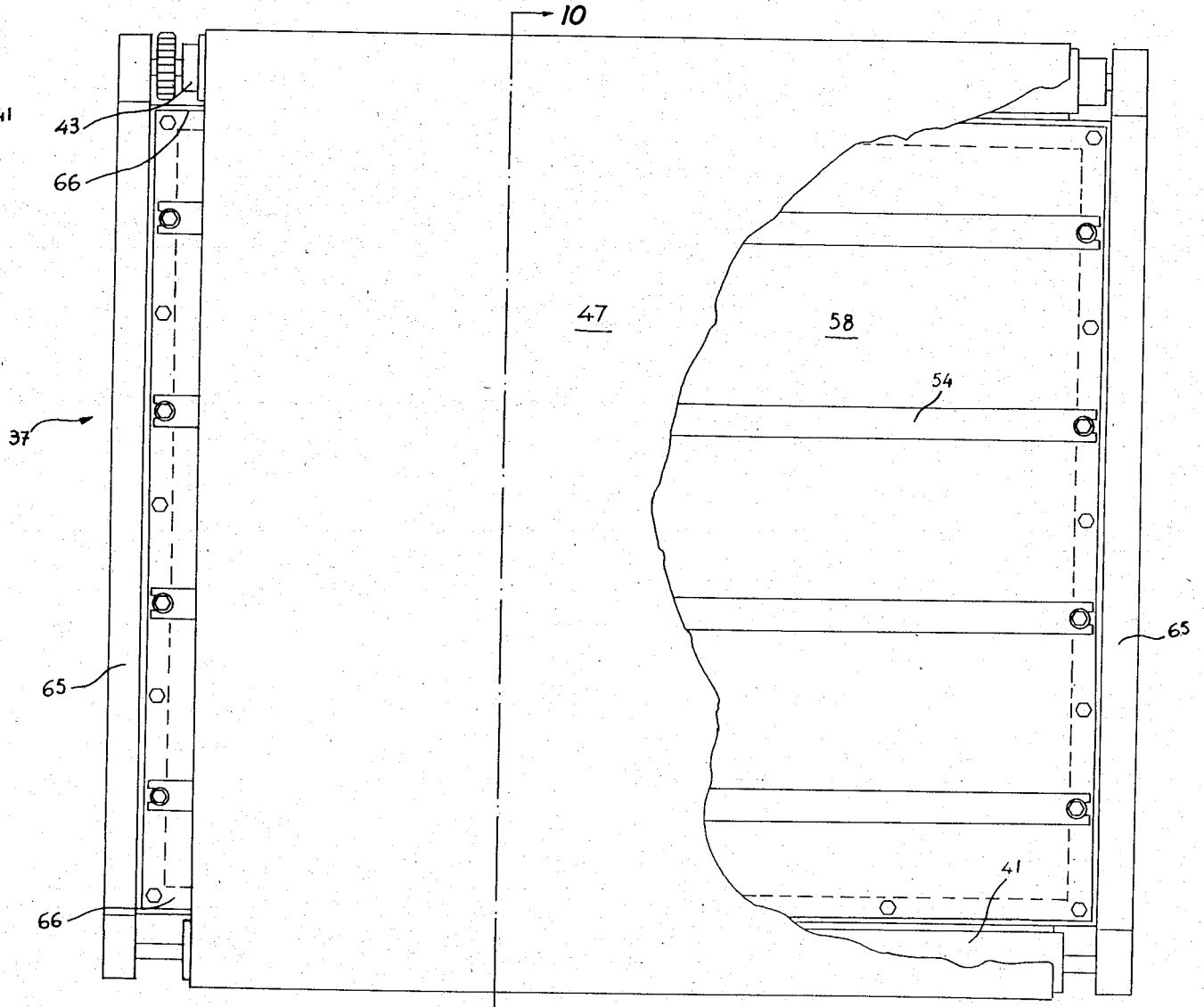
FIG. 9 is a front elevation view, partly broken away of another conveyor of the heat and pressure applying apparatus depicted in FIGS. 5 and 6.
Figure 10:
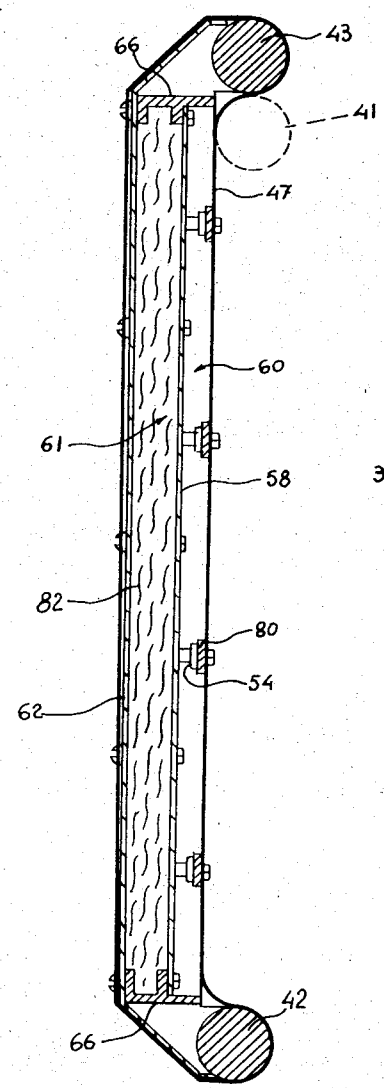
FIG. 10 is a cross-section view of the conveyor depicted in FIG. 9 taken along line 10—10 of FIG. 9.

Referring to FIGS. 9 and 10, frame 37 is fabricated similar to frame 36 except that the entrance and exit rollers are offset from the compartment 60 facing frame 36. C-brackets 64 (FIG. 10) can be used to secure the rollers to frame 37. The upper and lower brackets 66 are formed as V-channels (FIG. 6) with the point of the V facing the entrance and exit rollers. The V surfaces of the upper and lower brackets in cooperation with the C-brackets form transition surfaces which provide sliding surfaces for the belt 47. As shown in FIGS. 4 and 6, the conveyor 36 is received substantially within conveyor 37.

To facilitate cleaning and repair, conveyors 36 and 37 are each hinged to the machine housing or frame so that each can be pivoted on the housing independently of the other. This enables the conveyors 36 and 37 to be hinged apart as depicted in FIG. 4. The hinge apparatus comprises a spaced pair of hinges 70 secured to the housing, a spaced pair of hinges 72 secured to frame 36, a spaced pair of hinges 74 secured to frame 37, and a hinge pin 76. The pair of hinges 72 are interconnected by a web 78 which secures them to the frame 36. When hinged apart as shown in FIG. 4, the belt 47 of conveyor 37 is loosely retained by the frame 40 since the belt 46 of conveyor 36 is not bearing against belt 47.

The belt 46 of conveyor 36 extends about the spaced support members 54 and the rear panel 62 of frame 39 and about the rollers 41 and 42, as depicted in FIGS. 4 and 6. Belt 46 is loosely tensioned about the rollers 41 and 42 and the support surfaces. Belt 47 is disposed about rollers 43 and 44 and the spaced support members 54 and rear panel 62 of frame 40. A relatively large amount of slack is provided for belt 47 so that it becomes loosely tensioned by belt 46 when the conveyors 36 and 37 are hinged together.

The belts 46 and 47 are driven by the cooperation of the exit rollers 41 and 43 and therefore can be loosely tensioned as described above. The exit rollers 41 and 43 are pressed together as described above to form the exit nip 51. The exit rollers 41 and 43 are preferably coated with a resilient material such as natural or synthetic rubber or plastic, for example silicone rubber. The action of the rollers pressed together draws the belts through the nip and drives them even though they are loosely tensioned. Such an arrangement avoids many of the problems associated with tensioning and aligning belt conveyors. Entrance rollers 42 and 44 are not driven and are simply rotatably mounted.

According to the invention, structure need not be provided adjacent the belts for supporting them. Upon positioning the two frames together to tension belt 47, the action of the driven rollers 42 and 44 pulling the belts and the action of non-driven rollers 41 and 43 creating a drag on the belts tensions both belts 46 and 47 and causes them to move in an engaging condition. Engagement of the belts is enhanced by the disposition of roller 42 and the path belt 47 follows about roller 42.

Referring now to FIGS. 5–10, the oven 32 in one embodiment includes a number of heating elements 80 supported within the frames of the individual oven conveyors. The heating elements 80 are disposed along facing support members 54, and thus on both sides of the path along which the fabric pieces move. The heating elements are conventional and are disposed so that they extend horizontally through the frames. The heating elements in this embodiment actually form support surfaces for the belts and thereby are in intimate contact with the belts to better transfer heat thereto. The belts in turn transmit heat to the fabric pieces.

The compartment 61 of each oven is closed off by the upper and lower brackets and a respective sheet metal panel 58 in order to prevent as much as possible the escape of heat from the compartment. To the rear of each sheet metal panel 58 in compartment 60 is disposed insulation 82 (FIGS. 8 and 10) so as to prevent the loss of heat from the oven. Each compartment 60 in which the insulation is disposed is closed off by a respective sheet metal panel 62. The oven is therefore insulated to make it energy efficient. Moreover, the depth of the oven, i.e. the depths of compartments 60 is relatively shallow so as to provide a relatively small oven space. This also makes the oven energy efficient.

Although heating elements 80 have been illustrated and described, other heating means can be utilized with the heat both passing between support members 54 and heating the support members 54. Additionally, a sheet, solid or foraminous, could be disposed over support members 54 and heated by heating elements 80 or other heating means. Also, the support members 54 can be replaced by the sheet. Moreover, it is within the contemplation of the invention that the sheet be flexible, that it be resiliently supported and that the support members 54 be disposed on either side of the flexible sheet or be omitted and replaced by the sheet or other structure.

Figure 12:
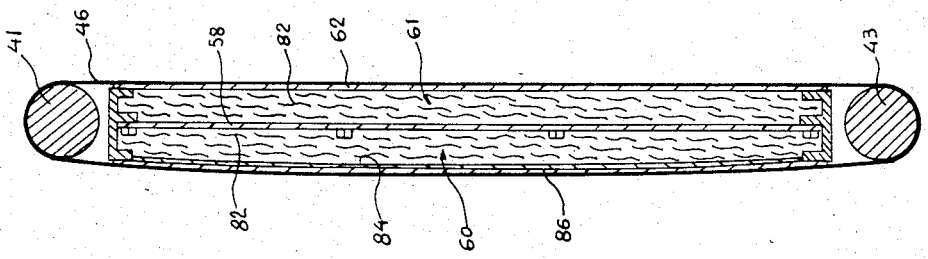
FIG. 12 is a cross-section view of the conveyor depicted in FIG. 11 taken along line 12—12 of FIG. 11.
Figure 11:
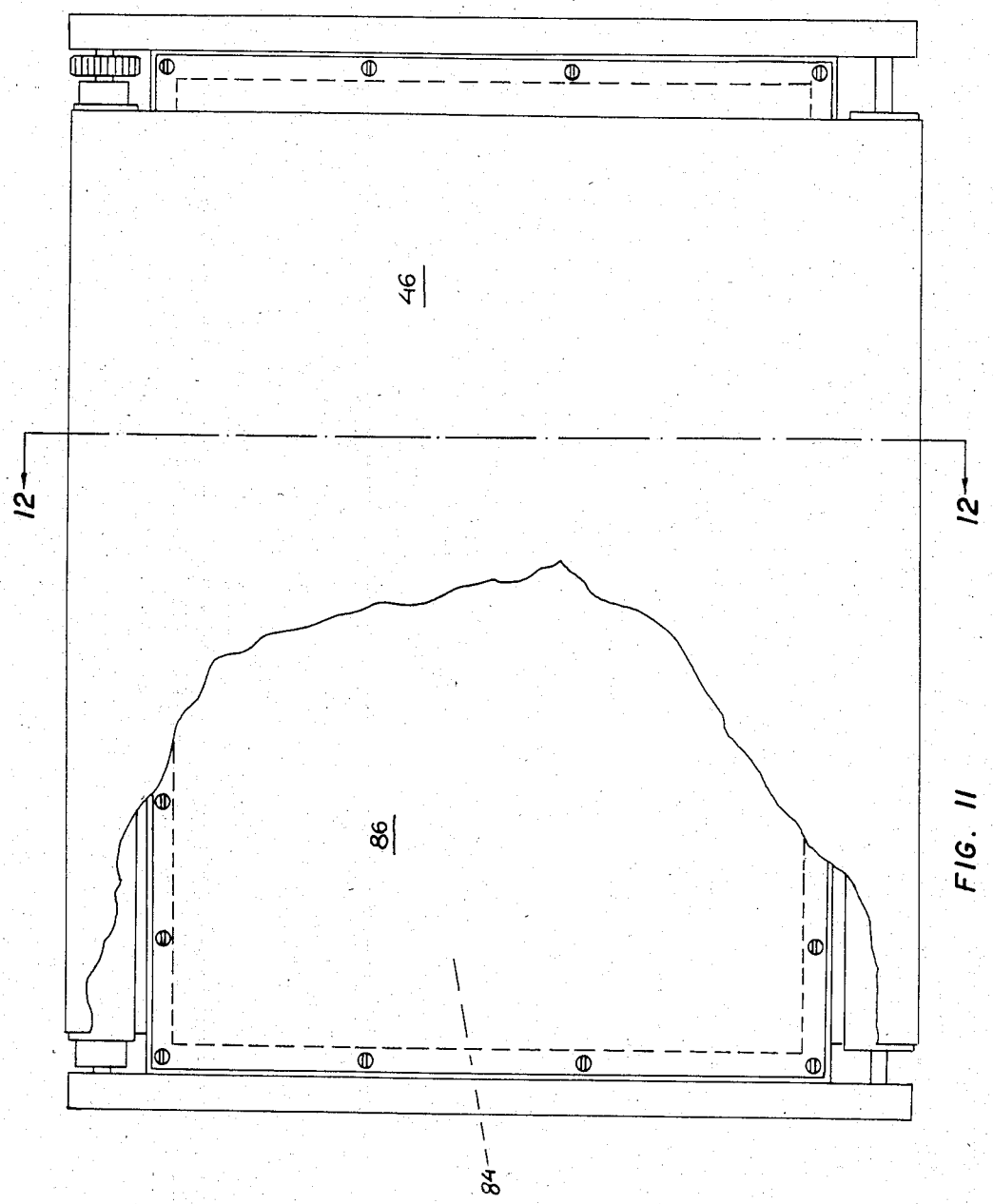
FIG. 11 is a front elevation view, partly broken away, of another embodiment of one conveyor of the heat and pressure applying apparatus of the fusing machine of FIG. 1.
Figure 13:
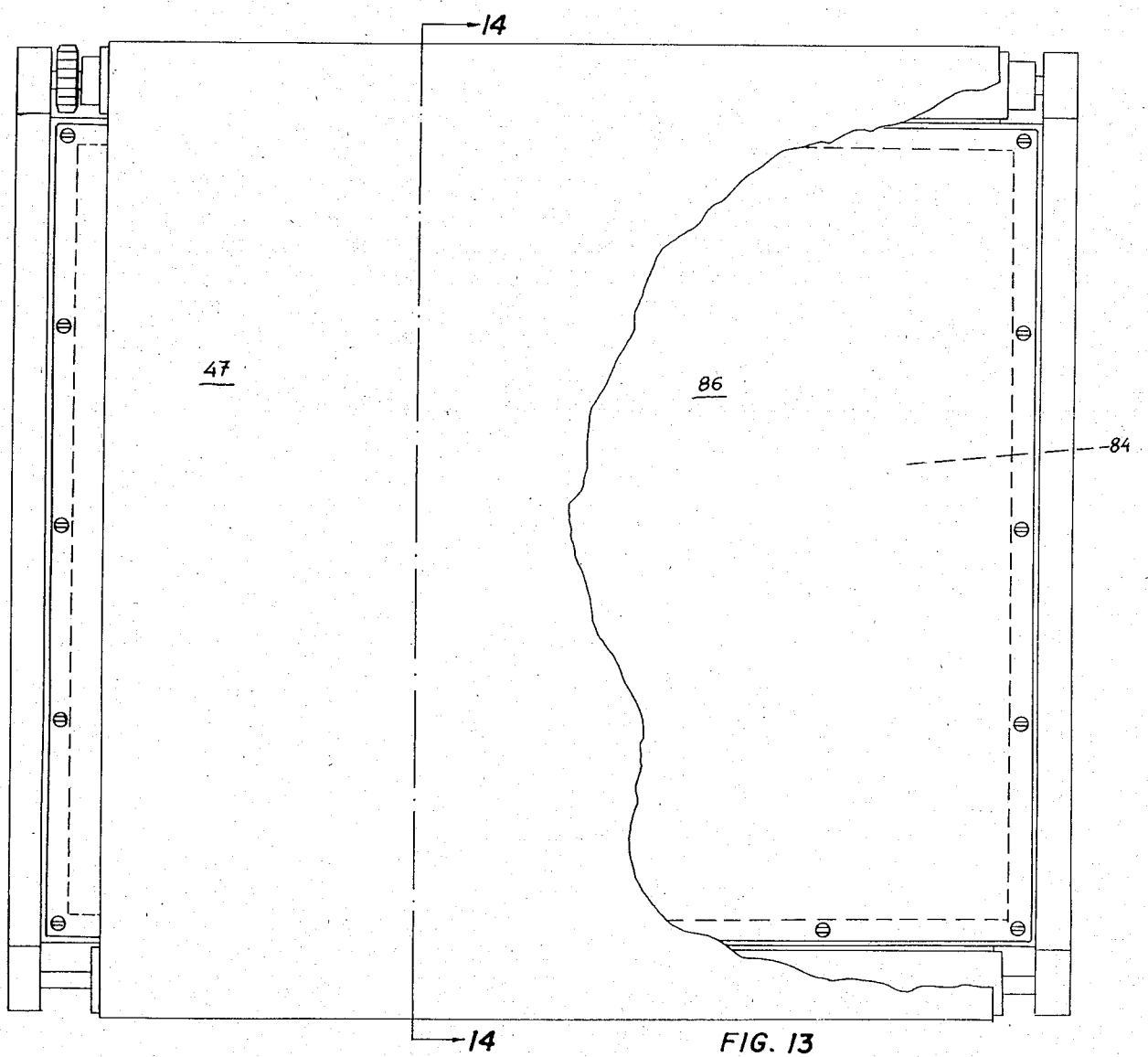
FIG. 13 is a front elevation view, partly broken away, of an embodiment similar to that of FIG. 11 of the other conveyor of the heat and presssure applying apparatus of the fusing machine of FIG. 1.

Referring now to FIGS. 11–13, conveyors 36 and 37 are constructed as generally described with respect to FIGS. 5–10 as regards the frame, rollers, belts and compartments. However, conveyors 36 and 37 do not include the support members 54 and heating elements 80 but instead utilize a respective flexible heating element resiliently supported over a respective compartment 60 by a resilient material such as insulation 82. The flexible heating element 84 can, for example, be a woven fabric or silicon rubber encapsulated resistive heating element available for example from The Ohmweve Co., Inc. of Niantic, Conn. Such elements are available in thin flexible sheets of woven fabric or silicone rubber in which are encapsulated resistive wire or foil. One or more of the sheets are disposed to substantially cover the opening to compartment 61. Preferably interposed between the flexible heating element 84 and the belt 37 is a thin, flexible, sheet-like element 86 made of low friction material which prevents frictional contact between the belt and the flexible heating element 84, thereby preventing the belt or the flexible heating element, or both, from wearing. Preferably the flexible sheet-like element 86 is made of a TFE-glass material, for example TFE coated glass fabrics which are availble from Taconic Plastics, Inc. of Petersburg, N.Y. Since the sheet-like member 86 is thin, its thermal properties are not of primary importance.

Compartment 60 is slightly over-stuffed with insulation 82, which is preferably compressible and may be fiber glass or compressible foam insulation, so that the insulation urges the flexible heating element 84, the sheet-like element 86 and the belt 46 outwardly of the compartment. Belt 47 of conveyor 37 is similarly resiliently urged outwardly (FIG. 14) so that the two belts resiliently engage articles disposed therebetween.

Since there is essentially no open space between the heating elements 84 and the belts, and essentially no space between the heating elements 84 and the insulation 82, the oven space is essentially zero.

Although insulation 82 in compartment 61 is preferred to impart resiliency to the belt, it is within the contemplation of the invention that other mediums can be used for that purpose, for example fluids such as compressed air.

It is also within the contemplation of the invention that other flexible heating means can be used, for example a membrane heated by, and/or transmitting heat from, heated fluids or infrared or microwave heating apparatus.

It is further within the contemplation of the invention that a flexible heating element constitute the belt 46. In such a case, the belt can be provided or coated with appropriate wear surfaces or one or more sheet-like elements 86 disposed adjacent or secured thereto. The belt can be conventionally supported or supported as described herein.

Figure 14:
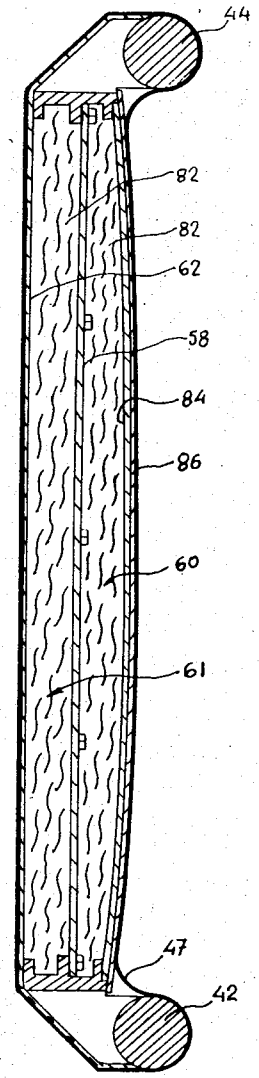
FIG. 14 is a cross-section view of the conveyor depicted in FIG. 13 taken along line 14—14 of FIG. 13.

Conveyor 37 depicted in FIGS. 13–14 is constructed generally as described above in connection with FIGS. 11–12.

In operation, the fabric pieces are heated as they vertically move through the oven between belts 46 and 47. The temperature of the fabric pieces progressively increases as they are moved through the oven. Thus, the fabric pieces reach the exit nip 51 at exit rollers 41 and 43 at an elevated temperature.

Rollers 41 and 43 are pressed together, as mentioned above, and apply pressure to the heated fabric pieces as they pass between the rollers to fuse the fabric (backing) pieces together. Apparatus for pressing the exit rollers 41 and 43 together is shown in FIG. 4. The pressure-applying apparatus, designated generally by 90, includes a pair of push rods 92 spaced apart and positioned to extend vertically adjacent the sides of frame 39. The push rods are preferably disposed in sleeves, not shown. Depending from each side of frame 39 is a corresponding rod 94, only one of which is shown, against which the push rods 92 bear in the closed condition of the oven to urge the frame 39 upwardly. Thus, roller 41 is urged upward with frame 39 and bears against roller 43. Each push rod 92 is connected to one end of a cantilevered rod 96. The other end of each cantilevered rod 96 is connected by a spring 98 to the housing 35. A fulcrum rod 100 is rotatably supported by and extends horizontally through the housing. Cams or eccentric bushings 102 are mounted on the fulcrum rod 100 below the cantilevered rods 96. Thus, the cams contact the cantilevered rods 96 and form support surfaces therefor. Each spring 98 draws the end of the cantilevered rod to which it is connected downwardly, thereby forcing the other end of the cantilevered rod to which the push rod 92 is connected upwardly into engagement with rods 94 of the frame 39. The contacting surfaces of the push rods 92 and the rods 94 can be configured to form interlocking surfaces. For example, one of the rod surfaces can be recessed and the other surface can be provided with a mating projection. The size and shape of the cams 102 can be selected so as to be able to adjust the force applied to the frame 39 and consequently the pressure applied between rollers 41 and 43. Thus, the cams 102 can include surface areas which contact the rod 96 at varying distances from the fulcrum rod 100. Rotation of the fulcrum rod 100 causes the cams 102 to either tension or release the tension of springs 98. Thus, the rollers 41 and 43 can be released from engagement, for example when pivoting the frames open, as shown in FIG. 4. A portion (not shown) of the fulcrum rod extends exteriorly of the housing and a handle is secured thereat so that the rod can be manually rotated. The springs provide resilience to enable the frame 40 to move automatically, should pieces of different size be supplied to the machine or should accumulations or residues build on or a piece become stuck to a belt surface, without damaging the machine or requiring constant readjustment. Moreover, since two push rods and two springs are provided, there can be a slight difference in the pressure applied at the two ends of the rollers.

The fusing machine is provided with a switch which energizes and de-energizes the heating elements in response to the action of the fulcrum rod in forcing the upper oven rollers 41 and 43 into engagement. Thus, the heating elements are automatically switched off when the force applied to rollers 41 and 43 to urge them together is released. This occurs when the fulcrum rod is rotated either to substantially fully release pressure or during the process of pivoting the oven frames apart.

Figure 15:
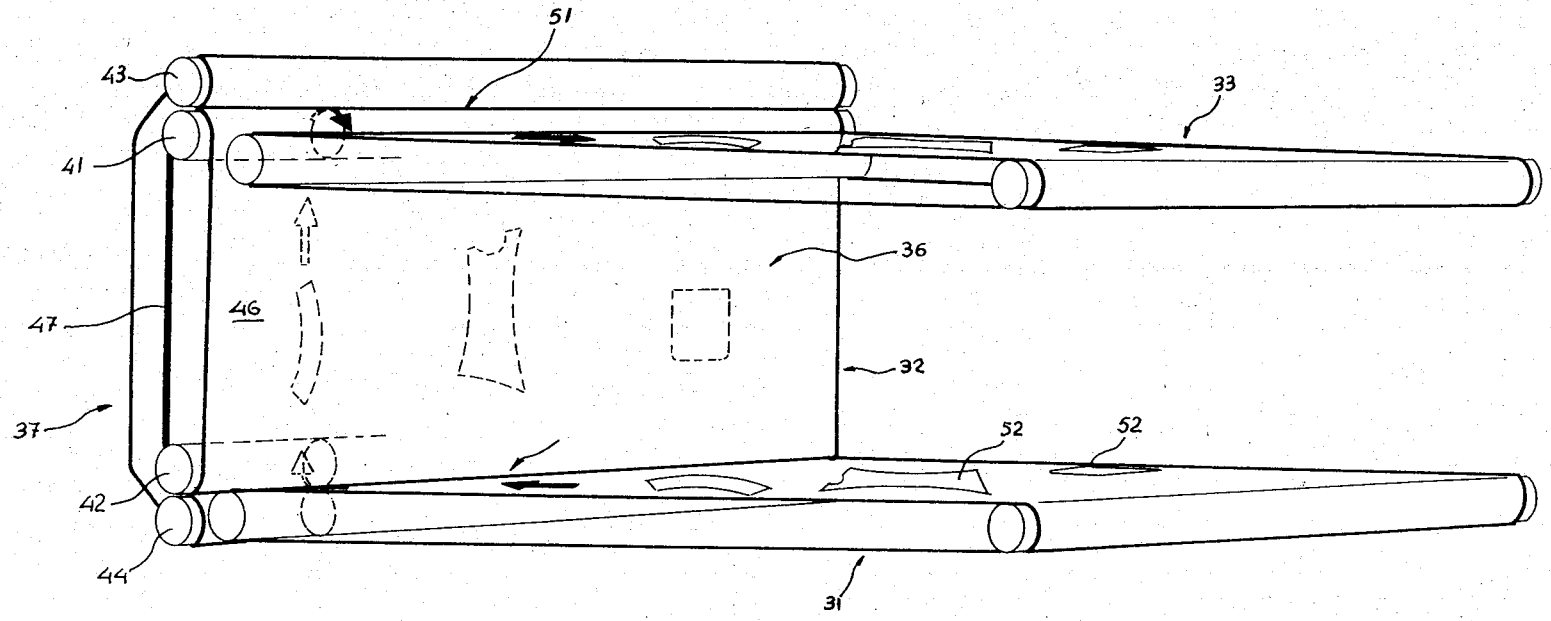
FIG. 15 is a schematic side view in perspective of a portion of the fusing machine of FIG. 1 depicting the travel of fabric pieces through the machine.

Referring to FIG. 15, fabric pieces 52 are deposited on feed conveyor 31 and are delivered to the entrance nip 49 of the oven 32. Belts 46 and 47 of conveyors 36 and 37 rotating with non-driven rollers 42 and 44 draw the fabric pieces into the oven through the entrance nip 49 formed by the pair of entrance rollers 42 and 44. Belts 46 and 47 cooperate as described above to retain fabric pieces passing between the rollers 42 and 44 and vertically transport the fabric pieces to the nip 51 of exit rollers 41 and 43. After being carried between driven exit rollers 41 and 43 by belts 46 and 47, the fabric pieces are discharged onto the discharge conveyor 33. As indicated above, the fabric pieces are fed horizontally to the oven 32, are carried vertically through the oven and are then discharged from the oven, again in a horizontal direction. After discharge from the oven, the pieces can be cooled, as by a cooling air flow (not shown), for example.

The feed and discharge conveyors 31 and 33, respectively, are superposed and in cooperation with the reversing oven 32 define a return-to-operator machine. A single operator standing adjacent the conveyors 31 and 33 can both deposit fabric pieces on the feed conveyor 31 while removing fused pieces from the discharge conveyor 33.

The height of the upper conveyor, which in the preferred embodiment is the discharge conveyor, is advantageously between waist and chest height of an average worker, i.e., from about two and one-half to about five and one-half feet above the floor surface on which the machine is disposed. The height of the lower conveyor, which in the preferred embodiment is the feed conveyor, is approximately slightly below, slightly above or at about waist height, i.e. about two or about three and one half feet above the floor surface. Although the run of the feed and discharge conveyors is shown to be horizontal, the runs can be inclined at desired angles so as to reduce or increase the distance between the conveyor surfaces along the run of the conveyors. Individuals can then position themselves along the conveyors so that the upper and lower conveyors are at suitable heights for the particular individual. The vertical distance over which the oven moves the fabric pieces is determined by temperature requirements in cooperation with the number and type of heating elements in the oven and the desired difference in height between the feed and discharge conveyors, and can vary from about one to about three feet. The heights of the feed and discharge conveyors, and the difference in their heights are not critical, but are selected to enable an operator to both deposit and remove articles from the two conveyors.

In order to better enable an operator to see the lower conveyor, the two conveyors can be spaced by a suitable distance. Preferable, however, at least the upper conveyor is transparent. For example, the belt could be made of a clear material or can be netted, foraminous, etc. A transparent belt made of Mylar has been found to be suitable with respect to optical, thermal and mechanical considerations. The belt thickness is selected in accordance with mechanical and thermal considerations and could be about 0.010 inch thick.

The width of the fusing machine can be selected to fuse a number of columns of fabric pieces, three columns being illustrated in FIG. 15. Also the fabric pieces need not be fed in columns but may be randomly placed on the feed conveyor. The fabric pieces can be of varying sizes and can even be fed continously from a roll. The precise number of fabric pieces which can be placed on the feed conveyor will depend upon the width and shape of the fabric pieces being fused. A number of operators can deposit and remove fabric pieces. For example, several operators can be positioned on each side of the feed and discharge conveyors and additional operators can be positioned at the end of the conveyors. By employing several operators on each side of the feed and discharge conveyors and a number of operators at the end of the conveyors, a large number of fabric pieces can simultaneously be fed to the machine and removed after fusing. The deposit and removal of pieces from the conveyors can be automated, if desired. Typically, the pieces are bundled after fusing.

The drive system for the fusing machine includes a single electric motor 34 coupled to a number of rollers by a transmission including belts, pulleys and gears. Referring to FIGS. 1 and 3, the motor 34 is coupled by belts to lower pully 110 fixed to the shaft 111 of a driving roller 112 for the lower conveyor 31 and to upper pully 113 disposed adjacent to the upper conveyor 33. Upper pulley 113 is fixed to a shaft 115 to which an idler gear 117 is also fixed. The idler gear 117 meshes with gears 118–120 respectively fixed to the shafts of rollers 41 and 43, and drive roller 123 for the upper conveyor 33. The lower or entrance rollers 42 and 44 of the oven are not coupled to the drive transmission and are rotatably mounted in a respective frame. Thus, one of the rollers of each of conveyors 31 and 33 and one of the rollers of each of the oven conveyors are driven, all by a single motor.

The drive transmission also includes a clutch 125 coupling the pully 110 to drive roller 112 and a clutch associated with gear 118 coupling the drive to roller 123. The clutches can be activated by individually disengage rollers 112 and 123 while drive power continues to be supplied to the oven drive rollers.

Several embodiments of apparatus for guiding endless belts are illustrated in FIGS. 16–24. The guiding apparatus can be used to guide one or more belts of the fusing machine described herein.

Figure 16:
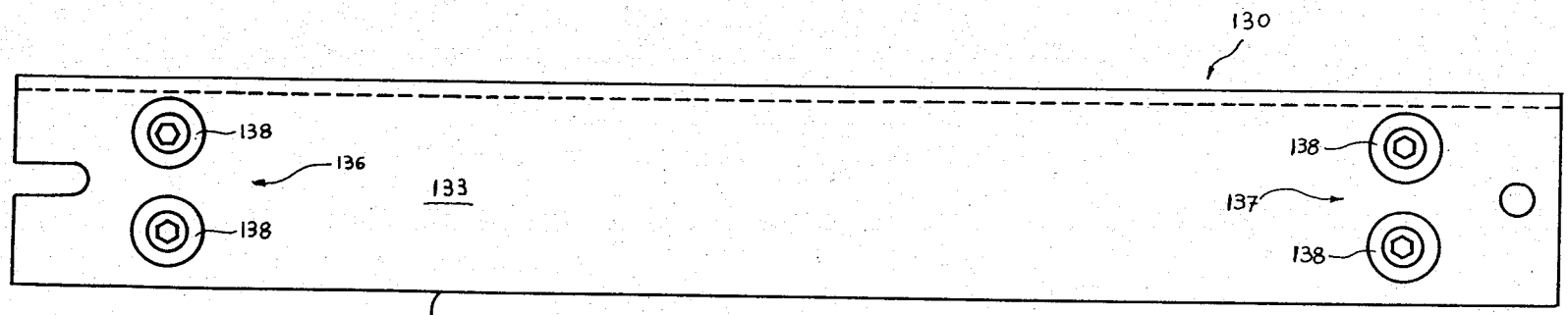
FIG. 16 is a top plan view of one embodiment of belt guiding apparatus which can be used in the fusing machine of FIG. 1.
Figure 17:
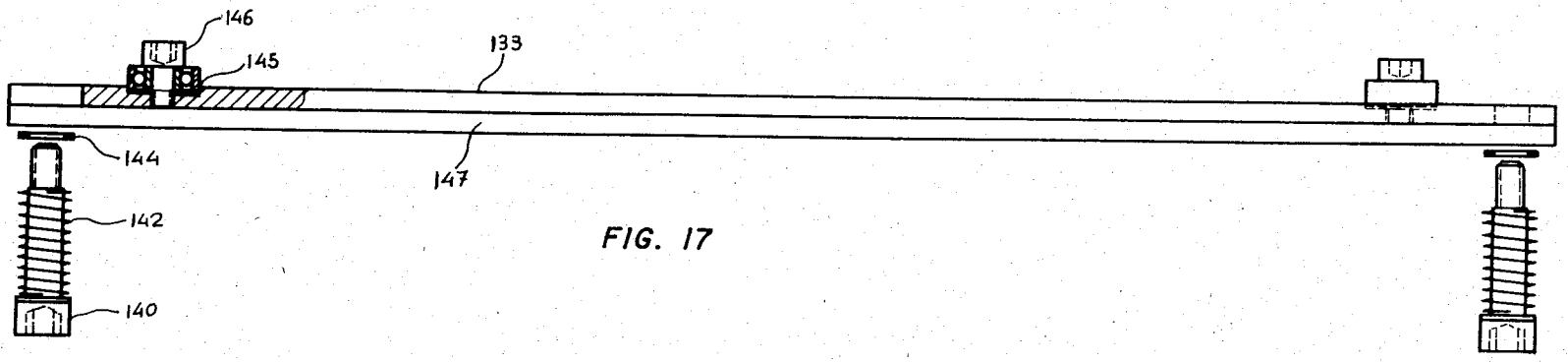
FIG. 17 is an end elevation view, partly in section, of the belt guiding apparatus of FIG. 16.

Referring to FIGS. 16 and 17, one embodiment of a guide apparatus 130 includes a flat plate 132 and spaced pairs 136 and 137 of roller bearings 138 disposed adjacent the ends of the plate. Although two roller bearings 138 are preferably disposed on each side of the belt, only one roller bearing could be provided on each side of the belt. An endless belt, not shown, is adapted to slide along the top surface 133 of plate 132 between the pairs of rollers bearings 136 and 137 with the edges of the belt being guided by the roller bearings. The plate 132 is mounted to extend across the belt generally at a right angle to the direction of travel of the belt. The plate 132 is mounted in a conveyor system by means of support bolts 140 secured to a support frame (not shown) of the conveyor and extending through a hole or slot in the plate. Coil springs 142 are disposed on the shaft of the bolts over which a washer 144 is disposed as a bearing surface for the plate 132. The plate is thus engaged by the coil springs and is thereby resiliently mounted in the conveyor. Each roller bearing 138 is partially disposed in a recess 145 in the plate and is secured thereto by a bolt 146 extending through the bore of the bearing into the plate. The roller bearings of each pair are spaced along the direction of travel by a sufficient distance to provide two guiding locations, which are essentially point contacts, on each side of the belt. Preferably, either the belt or the plate surface, or both, are made of a low friction material so that the belt can slide across the plate easily. The plate 132 can include a flanged edge 147 to provide rigidity.

The guide 130, as are guides 150 and 160 described below, is mounted on the return run of the belt upstream of the driver roller for the respective conveyor. Thus, the guide insures that the belt is fed to the drive roller in proper alignment therewith. The guide apparatus herein enables the belt to be relatively loosely tensioned, particularly, in cooperation with a driven nip such as 51.

Figure 19:
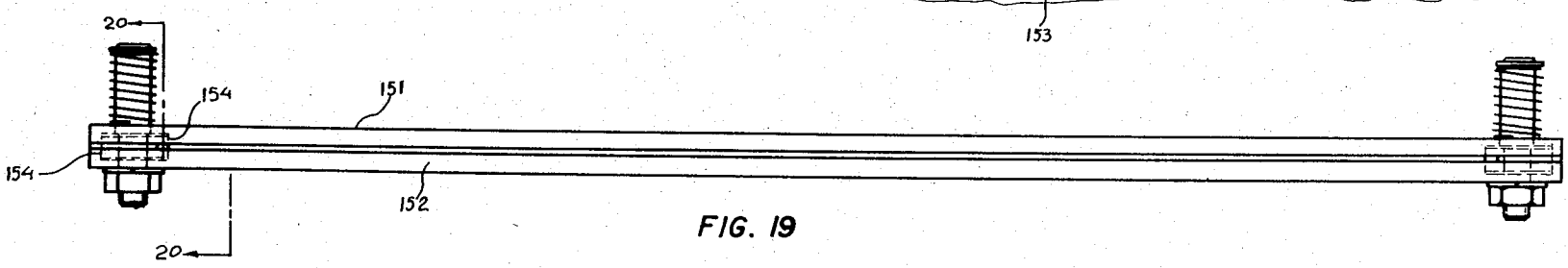
FIG. 19 is an end elevation view of the belt guiding apparatus depicted in FIG. 18.

The guide depicted in FIGS. 16–17 can advantageously be used to guide the belts in the conveyor oven. The plate 132 is resiliently bolted to the frame of a respective oven conveyor by bolts 140 and overlies the rear sheet metal panel 62 of the frame, as shown in FIG. 1. In order to properly space the plate away from the sheet metal panel 62 so as to allow the belt to pass between the two, a spacer insert 149 (FIG. 21) is interposed between the plate and the sheet metal panel adjacent the bearings. Openings are provided in the spacer for the bearings. The thickness of the spacer corresponds generally to the thickness of the belt being guided. The sheet metal panel includes openings or recesses into which the roller bearings extend. The plate 132 and sheet metal panel 62 will appear generally as shown in FIG. 19 for a two plate guide embodiment discussed below, with one of the plates in FIG. 19 representing the sheet metal panel 62. The springs 142 allow the plate to move should there be accumulations or residues on the belt surface or should a fabric piece become stuck to the belt surface.

Figure 21:
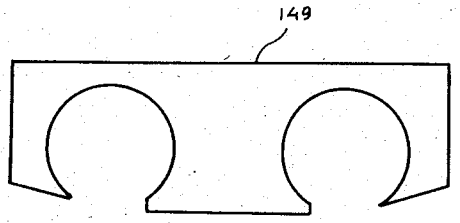
FIG. 21 is a top plan view of a spacer insert for the belt guiding apparatus depicted in FIGS. 16 or 18.

Referring next to FIGS. 18–21, another embodiment of a belt guide apparatus is depicted. Guide apparatus 150 differs from apparatus 130 in that two plates 151, 152 are utilized, one on each side of the belt 153. Each plate 151, 152 includes a recess 154 for each roller bearing so that both ends of each roller bearing are disposed in opposed, aligned recesses of the opposed plates, as shown in FIG. 19. The depth of the recesses and the height of the roller bearings are selected to provide a predetermined distance between the plates sufficient to allow movement of the belt 153 between the plates. Preferably, the surfaces of the two plates or the belt, or both, are made of low-friction material. The spacer insert 149 shown in FIG. 21 is interposed between the plates enclosing the roller bearings (except where they are to contact the belt) to insure proper spacing between the plates. The spacer 149 is consequently provided with openings in which the roller bearings are disposed. The roller bearings are secured between the plates and the plates secured together by means of bolts 158 and nuts 159. A coil spring 142 is mounted on one side of the bolts extending through one of the plates so as to resiliently secure the plates together. Means, not shown, are provided for securing the plates to supporting structure for the conveyor. The guide 150 can be secured to a conveyor as shown for example in FIG. 27.

Figure 18:
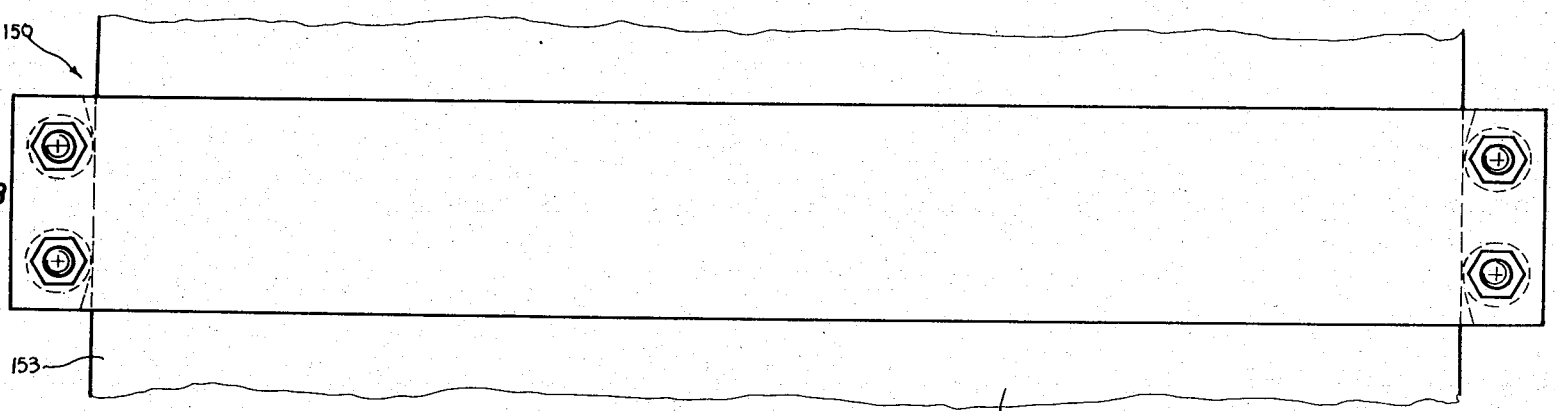
FIG. 18 is a top plan view of another embodiment of belt guiding apparatus which can be used in the fusing machine of FIG. 1.
Figure 20:
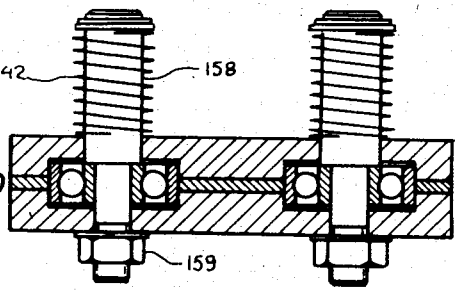
FIG. 20 is a cross-section view of the belt guiding apparatus of FIG. 18 taken through line 20—20 in FIG. 19.
Figure 22:
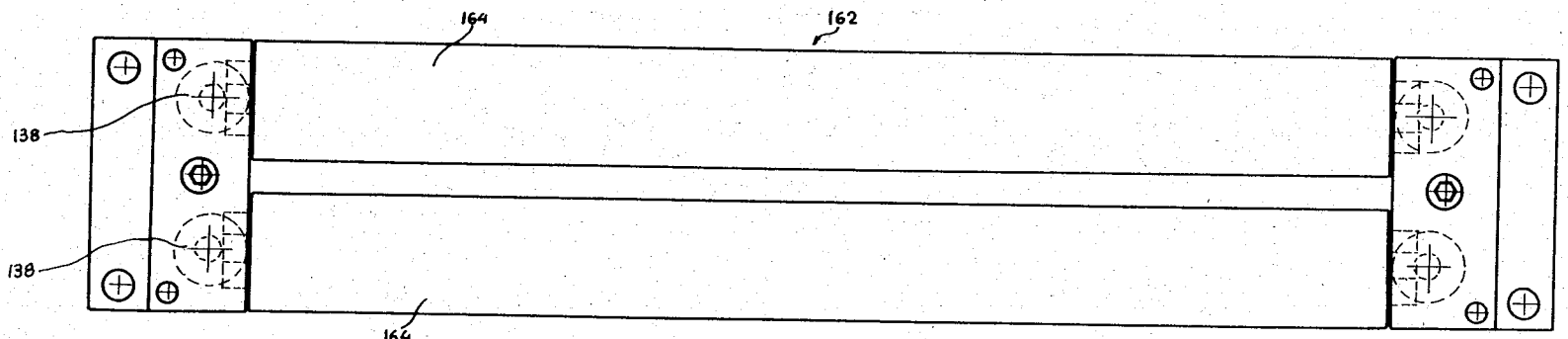
FIG. 22 is a plan view of another embodiment of a belt guiding apparatus which can be used in the fusing machine of FIG. 1.
Figure 23:
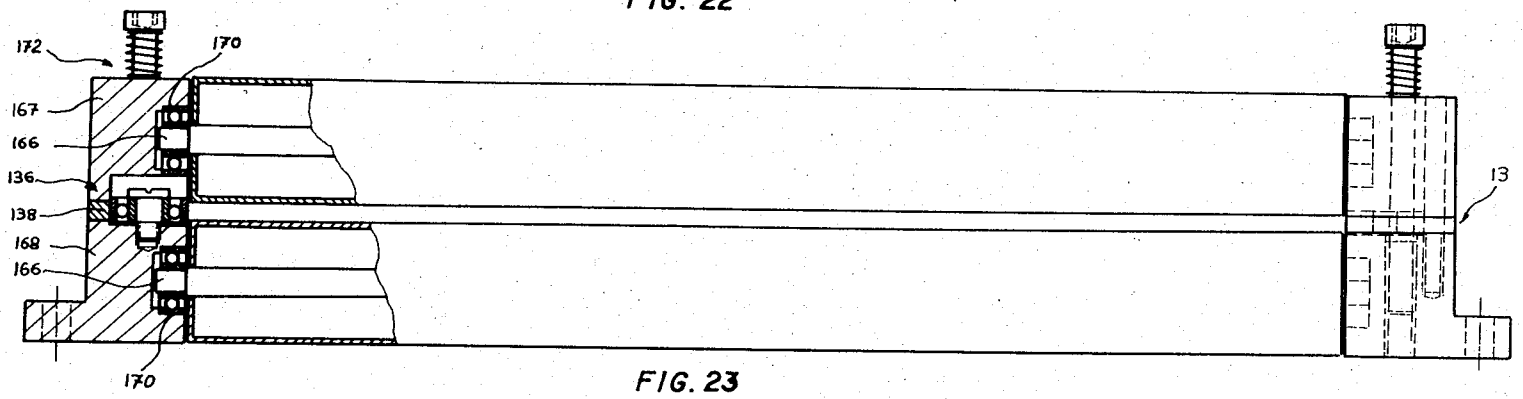
FIG. 23 is an end elevation view, partly in section, of the belt guiding apparatus depicted in FIG. 22.
Figure 24:
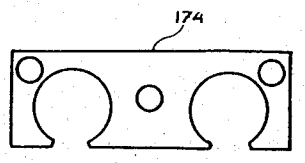
FIG. 24 is a top plan view of a spacer insert of the belt guiding apparatus depicted in FIG. 22.

In the embodiment shown in FIGS. 18–20, the guide apparatus 162 utilizes opposed rolling cylinders 164 instead of the opposed plates of guide 150. The shaft 166 of each cylinder extends beyond the ends of the cylinder and is mounted in opposed pairs of upper and lower supports 167, 168 by roller bearings 170. A pair 136, 137 of roller bearings 138 is disposed adjacent each end of the cylinders to contact and guide the edge of the belt, as in the embodiments of FIGS. 16–21. The roller bearings are mounted to the lower supports 168 as generally described for the embodiment of FIGS. 16–17. The supports for each roller on the respective side of the roller are secured together by a resilient spring arrangement 172 similar to that depicted in FIGS. 18–21, except that the bolts do not pass through the bearings. A spacer insert 174 (FIG. 24), similar to spacer insert 149, is interposed between the support for the upper and lower rollers. The rollers may move apart under action of the springs to accommodate any accumulations, residues or pieces on the belt surface, as do the plates in the embodiments of FIGS. 16–21.

The guide apparatus of FIGS. 16–24 guides the flat surface(s) of the belt as well as the edges of the belt mechanically and thereby eliminates more complicated hydraulic or pneumatic equipment.

Figure 25:
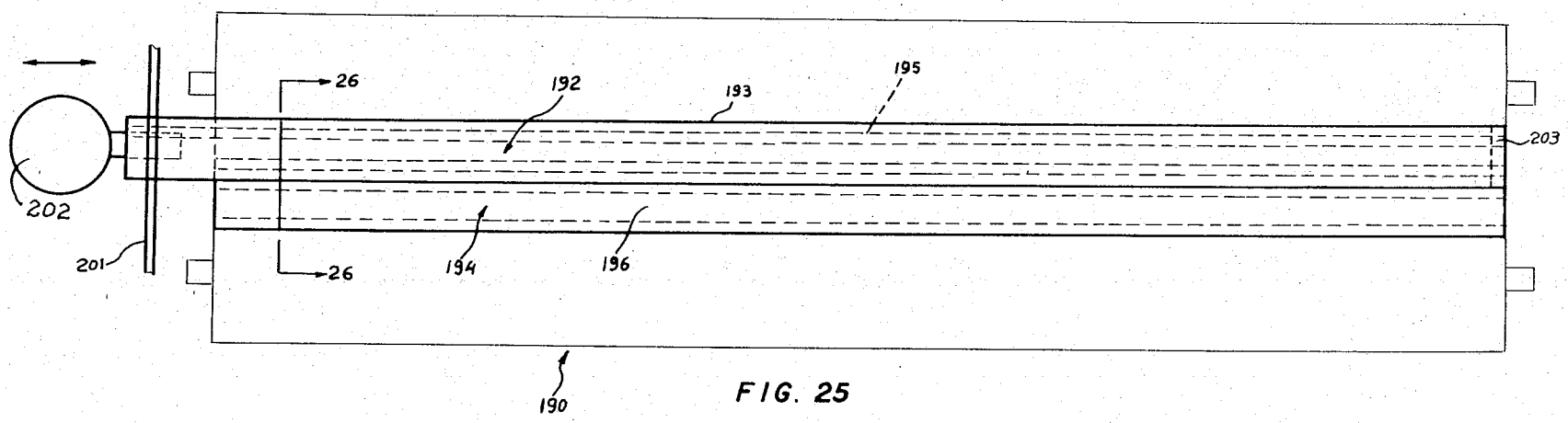
FIG. 25 is a top plan view of belt cleaning apparatus which can be used in the fusing machine of FIG. 1.
Figure 26:
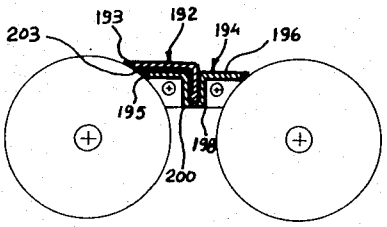
FIG. 26 is a cross-section view of the belt cleaning apparatus of FIG. 25 taken along line 26—26 of FIG. 25.

Referring now to FIGS. 25 and 26, apparatus 190 for cleaning the belt surfaces or surfaces of cylinders or rollers is shown. An apparatus 190 can be disposed between adjacent rollers over which a belt passes. The cleaning apparatus 190 includes a first or primary doctor or scraper blade 192 having a single blade edge 193, and a second or auxiliary doctor or scraper blade 194 having a blade edge 195 disposed adjacent and extending parallel to a cylinder (belt) to be cleaned. Blade 194 includes a portion 196 extending to an adjacently disposed roller to bridge the distance between the two rollers. The doctor blade 194 is semi-permanently mounted, for example bolted, to a support structure extending between a pair of rollers, and includes a slot 198 open at the top of the blade and extending along the length of the blade parallel to the blade edge and the axes of the adjacent cylinders. The primary doctor blade 192 is disposed over the auxiliary doctor blade 94 to doctor the cylinder (or belt surface). Thus, the edge of doctor blade 192 extends parallel to and upstream of the edge of doctor blade 194. Primary doctor blade 192 is slidably received in the slot 198 of the lower secondary doctor blade and includes a depending portion 200. Thus, blade 192 can be formed as an angle with one side disposed over blade 194 and the other side disposed in slot 198. The slot 198 at the bottom thereof includes an enlarged portion in the shape of a cylindrical recess. The depending portion 200 of the blade 192 includes a cylindrical portion corresponding to the shape of the recess. One end of the slot 198 is open so that the blade 192 can be slid out of the slot and removed from the apparatus. However, once the depending portion 200 of blade 192 is disposed in the slot 198, it cannot be vertically removed. A scraper 201 is secured to either or both sides of the upper, first doctor blade 192 and scrapes the surface of the lower doctor blade 194 as the upper doctor blade is slid along the lower doctor blade. A stationary scraper 203 is secured adjacent to upper doctor blade 192 to clean it as it is slid along the lower doctor blade. The blade 192 can thus be removed to be cleaned or repaired, or to remove accumulated material thereon, without having to shut the machine down since the lower secondary doctor blade 194 remains in position for doctoring. A handle 202 is provided so that the removable doctor blade 192 can be grasped and slid in either direction out of the slot 198. A cleaning apparatus 190 can be used to clean one or more belts of the fusing machine described herein and can, for example, be disposed between cylinders as shown in FIG. 27.

The mechanical urging means for the oven drive cylinders 41 and 43, the belt guiding apparatus described above and the belt cleaning apparatus described above each contribute to making a fusing machine in which they are utilized maintenance free. Combinations of the three, each of which does not use hydraulics or pneumatics, makes such a fusing machine substantially maintenance free.

Figure 27:
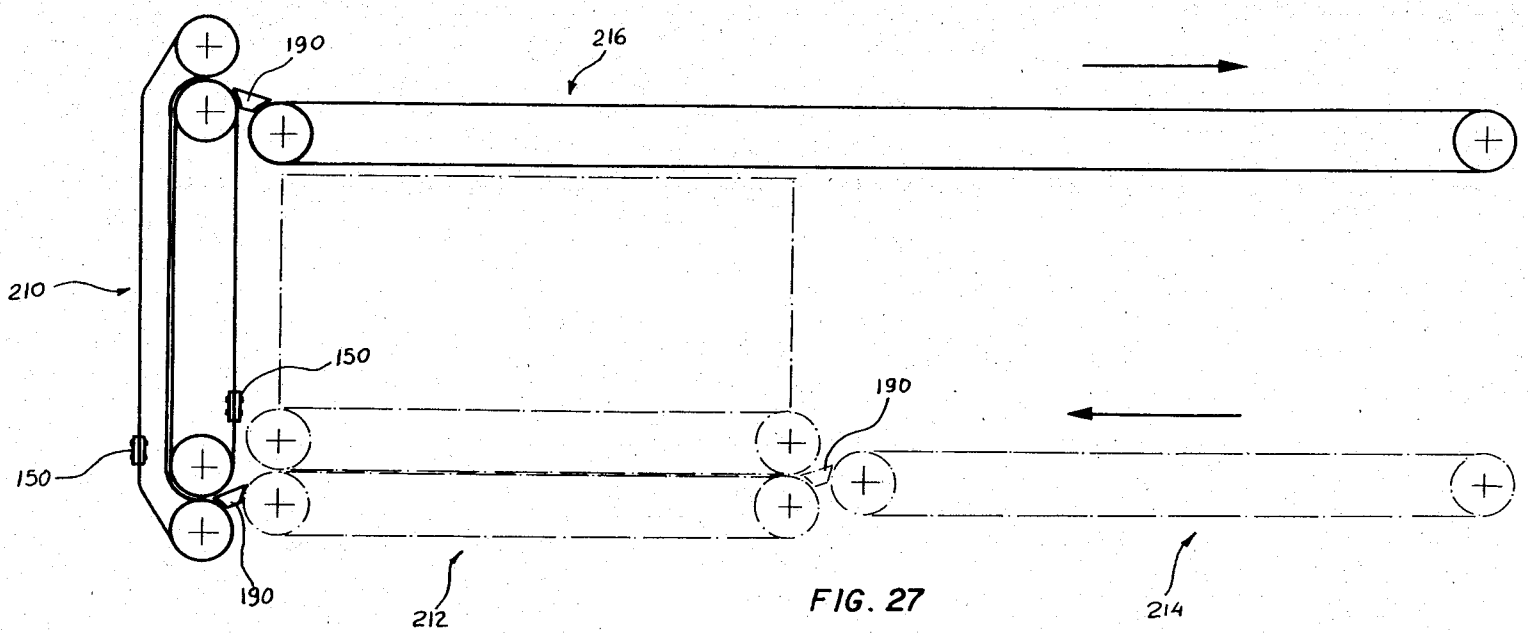
FIG. 27 is a side schematic view of direction reversing apparatus for converting an in-line machine to a return-to-operator machine.

Referring now to FIG. 27, a direction-reversing conveyor apparatus 210 is illustrated. The direction-reversing apparatus 210 is advantageously provided to be fitted, for example, to a fusing machine to convert it from an in-line machine to a return-to-operator machine. Such an in-line fusing maching will typically include an oven 212 in which heat and pressure are applied to the fabric pieces, and a feed conveyor 214. The oven can be a conventional belt or drum oven. The direction-reversing conveyor 210 is disposed adjacent to the oven 212 to receive fused pieces from the oven and vertically transport the fused pieces and discharge them onto another horizontally-extending conveyor 216. The horizontally-extending conveyors and the oven section are disposed generally as described for the embodiment of FIG. 1, so far as physical arrangement is concerned, and preferably the upper conveyor 216 is transparent. The direction-reversing conveyor 210 is similar to the oven 30 of FIG. 1, except that heating elements need not be provided and fusing pressure need not be applied to the fabric pieces since they are already fused.

Referring now to FIGS. 28–30, apparatus 200 is depicted for adjusting the length of a conveyor. Mounted to each side member 202, 203 of a conveyor frame 204 at an end thereof in telescoping fashion is an extension arm 206, which arms cooperate to rotatably support an end roller (not shown) of the conveyor. Each extension arm includes an opening 208 in which an end of the shaft of the roller is rotatably received. Preferably, bearing means are associated with each opening to rotatably support the roller.

The arms 206 extend beyond the end cross-frame member 210 and are adjustable relative thereto. For that purpose, the side frame members 202, 203 are flanged to form an enclosure and the arms 206 include correspondingly shaped portions 212 which are slidably received in the side frames in a telescoping manner. The length of each arm portion 212 is selected in accordance with the amount of adjustment desired.

A gearing mechanism 214 is provided to adjust the arms in unison and to insure that both arms extend an identical distance from the end frame members. The gearing mechanism 214 comprises a rack gear 216 secured to or formed with the arm portion 212 at the underside thereof and wheel or pinion gear 218 supported from the frame in mesh with the respective rack gear 216. Each pinion gear 218 is fixed to a common shaft 220 which is rotatably supported from the conveyor frame with the respective pinion gears and rack gears in mesh. A handle 222 is fixed to the end of the shaft by which the shaft can be manually rotated and thereby adjust arms 206 in unison. The position of the extension arms can be fixed, for example, by means of an Allen screw 224 extending through a hole in the frame and threaded to the extension arm.

By adjusting the return run of the belt, the same belt can be used in a number of adjusted positions of the extension arms.

Although the extension arms have been shown extending parallel to the frame, they may extend at an angle, if desired.

Belt guide apparatus, as described above, can be utilized with one or more of the conveyors in FIGS. 1 or 27. For example, guide apparatus, designated 150, can be utilized with the conveyors of the direction reversing apparatus.

Belt cleaning apparatus 190 can also be utilized to clean one or more of the belt surfaces of the conveyors in FIGS. 1 or 27.

Conveyor length adjusting apparatus, as described above, can be utilized with one or move of the conveyors of FIGS. 1 or 27, for example the feed or discharge conveyors.

Advantageously, the direction-reversing apparatus 210 and associated feed and/or discharge conveyors as well as oven apparatus, conveyor apparatus, belt guide apparatus and belt cleaning apparatus can be provided individually or as combined units, preferably in kit form.

In accordance with a preferred embodiment, the rollers 41–44 can each be about 36 inches long to define an oven having an internal width of about 36 inches. The height of the oven can be about two feet. The depth of compartments 60 when not using insulation therein can be selected to provide an interior oven space of less than about two cubic feet in volume. When using insulation, the interior oven space can be essentially zero, i.e. surface heating. Such an above oven can occupy about five square feet of floor space.

Pressure ranges for rollers 41 and 43, conveyor speeds and oven temperatures will vary with the use to which the oven is put and will be known to those of skill in the art.

The advantages of the present invention, as well as certain changes and modifications of the disclosed embodiments thereof, will be readily apparent to those skilled in the art. It is the applicant's intention to cover by their claims all those changes and modifications which could be made to the embodiments of the invention herein chosen for the purpose of disclosure without departing from the spirit and scope of the invention.

What is claimed is:

1. A machine for applying heat and pressure to flat articles comprising heat and pressure applying apparatus including an entrance disposed for receiving articles delivered to the apparatus in a first direction transverse to the vertical and an exit vertically spaced from the entrance for discharging articles in a second direction transverse to the vertical, a feed conveyor having a moving conveyor surface for delivering articles to the entrance of the heat and pressure applying apparatus, the moving surface of the feed conveyor extending generally in said first transverse direction, a discharge conveyor having a moving conveyor surface for receiving articles discharged from the exit of the heat and pressure applying apparatus, the moving surface of the discharge conveyor extending generally in said second transverse direction and disposed substantially in vertical alignment with the moving surface of the feed conveyor, said feed conveyor and said discharge conveyor being exposed for a substantial distance and vertically spaced so that one or more operators adjacent said conveyors may both deposit articles on said feed conveyor and remove articles from said discharge conveyor, at least the moving surfaces of the upper of the feed and discharge conveyors being substantially transparent, so that an operator can better view the lower of the feed and discharge conveyors while depositing articles on or removing articles from the lower conveyor.

2. The machine according to claim 1 wherein the first and second transverse directions are generally parallel.

3. The machine according to claim 1 wherein the heat and pressure applying apparatus comprises a first conveyor comprising an entrance cylinder, an exit cylinder vertically spaced from the entrance cylinder and a movable conveyor surface extending in a direction transverse to the horizontal for a substantial generally linear distance and extending about the entrance cylinder and the exit cylinder, an engaging surface disposed adjacent and extending generally parallel to the movable conveyor surface, the movable conveyor surface cooperating with the engaging surface to engage articles therebetween and move articles engaged therebetween upon movement of the movable surface, the engaging surface including an entrance portion forming an entrance nip with the portion of the movable surface extending about the entrance cylinder, the entrance nip facing generally in said first transverse direction, and an exit portion forming an exit nip with the portion of the movable surface extending about the exit cylinder, the exit nip facing in said second transverse direction.

4. The machine according to claim 3 wherein the first conveyor includes support structure defining a support surface over which the movable surface is moved, the support surface extending in said direction transverse to the horizontal between the entrance and exit cylinders.

5. The machine according to claim 4 wherein the support structure comprises at least one sheet-like member extending in said direction transverse to the horizontal.

6. The machine according to claim 4 wherein said support structure is flexible.

7. The machine according to claim 4, 5, or 6 wherein said support structure is resilient.

8. The machine according to claim 6 wherein the support surface is offset from the axes of the entrance and exit cylinders away from the engaging surface, thereby causing the movable surface to follow a generally C-shaped path, the engaging surface being disposed between and generally aligned with the entrance and exit cylinders.

9. The machine according to claim 3 wherein the engaging means is C-shaped and the first conveyor is disposed substantially within the engaging means.

10. The machine according to claim 3 wherein the engaging surface is movable.

11. The machine according to claim 10 and comprising another entrance cylinder disposed adajcent said entrance cylinder and another exit cylinder disposed adjacent said exit cylinder vertically spaced from said another entrance cylinder, the movable engaging surface defining a conveyor surface extending about said another entrance cylinder and said another exit cylinder, a portion of the engaging surface which extends about said another entrance cylinder forming said entrance nip with a portion of said movable surface which extends about said another entrance cylinder, a portion of the engaging surface which extends about said another exit cylinder forming said exit nip with a portion of said movable surface which extends about said exit cylinder.

12. The machine according to claim 11 wherein the axes of the two entrance cylinders and the two exit cylinders are disposed substantially in a common place.

13. The machine according to claim 1 or 3 wherein the movable conveyor surface follows a substantially linear path between the entrance and exit cylinders.

14. The machine according to claim 3 wherein the exit cylinders rotate and comprising means for coupling the exit cylinders to a drive means.

15. The machine according to claim 1 wherein the heat and pressure applying apparatus comprises a movable conveyor surface mounted in a frame, an engaging surface mounted in another frame, and means for pivoting at least one of the frames so as to bring the movable conveyor surface and the engaging surface into and out of an adjacent disposition in which an article can be engaged between the movable surface and the engaging surface.

16. The machine according to claim 3 and comprising a first frame in which the entrance and exit cylinders of the first conveyor are disposed and a second frame in which the engaging surface is disposed, and means for pivoting at least one of the two frames so that the engaging and conveyor surfaces may be moved into and out of an adjacent disposition in which an article can be engaged between the movable surface and the engaging surface.

17. The machine according to claim 11 and including mechanical means for resiliently urging the exit cylinders together to thereby apply pressure to articles passed therebetween.

18. The machine according to claim 17 and comprising a first frame in which the entrance and exit cylinders of the first conveyor are supported and a second frame in which the entrance and exit cylinders of the engaging surface are supported, said urging means urging one frame towards the other frame.

19. The machine according to claim 1 wherein the heat and pressure apparatus comprises a first conveyor comprising an entrance cylinder, an exit cylinder vertically spaced from the entrance cylinder and a movable conveyor surface extending in a direction transverse to the horizontal for a substantial distance and extending about the entrance cylinder and the exit cylinder, an engaging surface disposed adjacent the movable conveyor surface between the entrance and exit cylinders, the movable conveyor surface and the engaging surface between the entrance and exit cylinders extending parallel to each other and defining a generally linear path, the movable conveyor surface cooperating with the engaging surface to engage articles therebetween and move articles engaged therebetween along the generally linear path upon movement of the movable surface, the engaging surface including an entrance portion forming an entrance nip with the portion of the movable surface extending about the entrance cylinder, either the engaging surface being curved adjacent its entrance portion or means being provided for causing the conveyor surface to follow a curved path from the entrance cylinder to the linear path, or both, so that the entrance nip faces generally in said first transverse direction, and an exit portion forming an exit nip with the portion of the movable surface extending about the exit cylinder, either the engaging surface being curved adjacent its exit portion or means being provided for causing the conveyor surface to follow a curved path from the linear path to the exit cylinder, or both, so that the exit nip faces in said second transverse direction.

20. A machine for applying heat and pressure to flat articles comprising heat and pressure applying apparatus including an entrance disposed for receiving articles delivered to the apparatus in a first direction transverse to the vertical, an exit vertically spaced from the entrance for discharging articles in a second direction transverse to the vertical, a first conveyor extending between the entrance and the exit having a movable surface and an engaging surface disposed adjacent thereto between which articles are adapted to be engaged and transported, and means for heating disposed adjacent at least one of the moving surface and the engaging surface on the side thereof opposite to the other of the moving and engaging surface, the respective surface being operative to transmit heat to articles engaged between the moving surface and the engaging surface;

a feed conveyor having a moving conveyor surface for delivering articles to the entrance of the heat and pressure applying apparatus, the moving surface of the feed conveyor extending generally in said first transverse direction, a discharge conveyor having a moving conveyor surface for receiving articles discharged from the exit of the heat and pressure applying apparatus, the moving surface of the discharge conveyor extending generally in said second transverse direction and disposed substantially in vertical alignment with the moving surface of the feed conveyor, said feed conveyor and said discharge conveyor being exposed and vertically spaced so that one or more operators adjacent said conveyors may both deposit articles on said feed conveyor and remove articles from said discharge conveyor.

21. The machine according to claim 20 wherein the means for heating comprises a flexible member.

22. The machine according to claim 21 and comprising means for resiliently supporting the flexible member.

23. A machine for applying heat and pressure to flat articles comprising heat and pressure applying apparatus including an entrance disposed for receiving articles delivered to the apparatus in a first direction transverse to the vertical and an exit vertically spaced from the entrance for discharging articles in a second direction transverse to the vertical, the heat and pressure applying apparatus comprising a first conveyor having a movable surface and an engaging surface disposed adjacent thereto extending along a path between the entrance and the exit of the heat and pressure applying apparatus including a generally linear portion, the movable surface and the engaging surface cooperating to transport articles disposed therebetween, the movable surface and the engaging surface further cooperating at least in said linear portion to apply pressure to articles disposed therebetween, a feed conveyor having a moving conveyor surface for delivering articles to the entrance of the heat and pressure applying apparatus, the moving surface of the feed conveyor extending generally in said first transverse direction, a discharge conveyor having a moving conveyor surface for receiving articles discharged from the exit of the heat and pressure applying apparatus, the moving surface of the discharge conveyor extending generally in said second transverse direction and disposed substantially in vertical alignment with the moving surface of the feed conveyor, said feed conveyor and said discharge conveyor being exposed for a substantial distance and vertically spaced so that one or more operators adjacent said conveyors may both deposit articles on said feed conveyor and remove articles from said discharge conveyor.

24. The machine according to claim 23 and comprising a guide for the moving surface of at least one of the feed, discharge and first conveyors, said guide comprising means for guiding the conveyor surface generally normal to the conveyor surface, first anti-friction means disposed adjacent a transverse edge of the movable conveyor surface for guiding each edge of the conveyor surface in the direction of movement of the conveyor surface, and second anti-friction means disposed adjacent an opposed transverse edge of the movable conveyor surface for guiding the opposed transverse edge of the conveyor surface in the direction of movement of the conveyor surface.

25. The machine according to claim 24 wherein respective guiding locations at opposed transverse edges of the conveyor surface are substantially opposite each other relative to the direction of motion of the conveyor surface.

26. The machine according to claim 24 wherein each anti-friction means comprises two spaced apart roller-element bearings each having a circular face adapted to contact a respective edge of the conveyor surface.

27. The machine according to claim 24 wherein said means for guiding comprises a flat surface extending adjacent to and transversely of the conveyor surface.

28. The machine according to claim 24 wherein said means for guiding comprises a spaced pair of surfaces extending adjacent to and transversely of the conveyor surface and between which the conveyor surface extends.

29. The machine according to claim 28 wherein said pair of surfaces are flat.

30. The machine according to claim 28 wherein said pair of surfaces are cylinder surfaces.

31. The machine according to claim 27, 28 or 29 wherein at least one of said surfaces is resiliently mounted.

32. The machine according to claim 23 and including apparatus for cleaning at least one of the moving surfaces comprising a first doctor blade having a blade edge and a second doctor blade having a blade edge, means for supporting the second doctor blade with its blade edge extending transversely of the direction of movement of the moving surface adapted to doctor the moving surface at a first location, and means for supporting the first doctor blade with an edge thereof extending transversely of the direction of movement of the moving surface adapted to doctor the moving surface at a second location upstream of and adjacent to the first location, the means for supporting the first doctor blade enabling the first doctor blade to be moved relatively easily relative to the moving surface and the second doctor blade while the second doctor blade remains stationary with its edge doctoring the moving surface at said first location.

33. The machine according to claim 32 wherein the edges of the first and second blades are parallel and extend axially along the circumference of a cylinder.

34. The machine according to claim 32 wherein the first doctor blade is supported by the second doctor blade, the means for supporting the first doctor blade comprising cooperating structure on the two blades.

35. The machine according to claim 34 wherein the cooperating structure comprises interlocking structure such that the first doctor blade can only be moved in a direction parallel to the blade edges.

36. The machine according to claim 35 wherein the first doctor blade carries means for cleaning the second doctor blade as the first doctor blade is moved in said direction.

37. The machine according to claim 32 wherein the second doctor blade extends transversely of the first doctor blade, the cleaning apparatus adapted to be disposed between two cylinders to bridge the distance therebetween.

38. The machine according to claim 31 wherein at least one of said conveyors comprises arm members slidably supported by the respective conveyor at an end thereof and means for supporting a roller of the conveyor from said arms, and comprising means for adjusting said arms in unison.

39. The machine according to claim 38 wherein said means for adjusting comprises a rack secured to each arm and a pinion gear supported in a meshed condition with the respective rack, and means for coupling the pinion gears to rotate in unison.

40. Conveyor apparatus for changing the direction of travel of generally flat articles comprising, a first conveyor comprising an entrance cylinder, an exit cylinder spaced from the entrance cylinder and a movable conveyor surface extending about the entrance cylinder and the exit cylinder, an engaging surface disposed adjacent the movable conveyor surface between the entrance and exit cylinders, the movable conveyor surface and the engaging surface between the entrance and exit cylinders extending parallel to each other and defining a generally linear path, the movable conveyor surface cooperating with the engaging surface to engage articles disposed therebetween and to move articles engaged therebetween along the generally linear path upon movement of the movable surface, the engaging surface including an entrance portion forming an entrance nip with the portion of the movable surface extending about the entrance cylinder, either the engaging surface being curved adjacent its entrance portion or means being provided for causing the conveyor surface to follow a curved path from the entrance cylinder to the linear path, or both, so that the entrance nip faces in a direction transverse to the first direction, and an exit portion forming an exit nip with the portion of the movable surface extending about the exit cylinder, either the engaging surface being curved adjacent its exit portion or means being provided for causing the conveyor surface to follow a curved path from the linear path to the exit cylinder, or both, so that the exit nip faces in a direction transverse to the first direction.

41. The apparatus according to claim 40 wherein the first conveyor includes support structure defining a support surface over which the movable surface is moved, the support surface extending generally parallel to said first direction between said entrance and exit cylinders.

42. The apparatus according to claim 41 wherein the support structure comprises at least one sheet-like member extending in said first direction.

43. The apparatus according to claim 41 wherein said support structure is flexible.

44. The apparatus according to claim 41, 42 or 43 wherein the support strucutre is resilient.

45. The machine according to claim 41 wherein the support surface is offset from the axes of the entrance and exit cylinders away from the engaging surface, thereby causing the movable surface to follow a generally C-shaped path, the engaging surface being disposed between and generally aligned with the entrance and exit cylinders.

46. The apparatus according to claim 40 wherein the engaging means is C-shaped and the first conveyor is disposed substantially within the engaging means.

47. The apparatus according to claim 40 wherein the engaging surface is movable.

48. The apparatus according to claim 47 and comprising another entrance cylinder disposed adjacent said entrance cylinder and another exit cylinder disposed adjacent said exit cylinder, the engaging surface defining a conveyor surface extending about said another entrance cylinder and said another exit cylinder, a portion of the engaging surface which extends about said another entrance cylinder forming said entrance nip with a portion of said movable surface which extends about said another entrance cylinder, and a portion of the engaging surface which extends about said another exit cylinder forming said exit nip with a portion of said movable surface which extends about said exit cylinder.

49. The apparatus according to claim 48 wherein the axes of the two entrance cylinders and the two exit cylinders are disposed substantially in a common plane.

50. The apparatus according to claim 40 wherein the first direction is transverse to the horizontal.

51. The apparatus according to claim 40 wherein the first conveyor surface and the engaging surface are mounted in respective frames, and comprising means for pivoting at least one of the frames so that the conveyor and engaging surfaces can be moved into and out of an adjacent disposition in which an article can be engaged can be engaged between the movable surface and the engaging surface.

52. The apparatus according to claim 48 and comprising a first frame in which the entrance and exit cylinders of the first conveyor are disposed and a second frame in which the entrance and exit cylinders of the engaging surface are disposed, and means for pivoting at least one of the frames so that the engaging and conveyor surfaces may be moved into and out of an adjacent disposition in which an article can be engaged between movable surface and the engaging surface.

53. The machine according to claim 48 and comprising means for heating disposed adjacent at least one of the moving surface and the engaging surface on the side thereof opposite to the other surface, the respective surface being operative to transmit heat to articles engaged between the moving surface and the engaging surface.

54. The apparatus according to claim 53 wherein the means for heating comprises a flexible member.

55. The apparatus according to claim 54 and comprising means for resiliently supporting the flexible member.

56. The machine according to claim 48 and including mechanical means for resiliently urging the exit cylinders together to thereby apply pressure to articles passed therebetween.

57. The machine according to claim 56 and comprising a first frame in which the entrance and exit cylinders of the first conveyor are supported and a second frame in which the entrance and exit cylinders of the engaging surface are supported, said urging means urging one frame towards the other frame.

58. A machine for applying heat and pressure to flat articles comprising heat and pressure applying apparatus including an entrance disposed for receiving articles delivered to the apparatus in a first direction transverse to the vertical, an exit vertically spaced from the entrance for discharging articles in a second direction transverse to the vertical, a movable conveyor surface mounted in a frame, an engaging surface mounted in another frame, and means for pivoting at least one of the frames so as to bring the movable conveyor surface and the engaging surface into and out of an adjacent disposition in which an article can be engaged between the movable surface and the engaging surface, a feed conveyor having a moving conveyor surface for delivering articles to the entrance of the heat and pressure applying apparatus, the moving surface of the feed conveyor extending generally in said first transverse direction, a discharge conveyor having a moving conveyor surface for receiving articles discharged from the exit of the heat and pressure applying apparatus, the moving surface of the discharge conveyor extending generally in said second transverse direction and disposed substantially in vertical alignment with the moving surface of the feed conveyor.

59. A machine for applying heat and pressure to flat articles comprising heat and pressure applying apparatus including an entrance disposed for receiving articles delivered to the apparatus in a first direction transverse to the vertical, a first conveyor having a movable surface, an engaging surface disposed adjacent to the movable surface between which articles are adapted to be engaged and transported, means including a flexible member for heating disposed adjacent at least one of the moving surface and the engaging surface on the side thereof opposite to the other surface, the respective surface being operative to transmit heat to articles engaged between the moving surface and the engaging surface, and an exit vertically spaced from the entrance for discharging articles in a second direction transverse to the vertical, a feed conveyor having a moving conveyor surface for delivering articles to the entrance of the heat and pressure applying apparatus, the moving surface of the feed conveyor extending generally in said first transverse direction, and a discharge conveyor having a moving conveyor surface for receiving articles discharged from the exit of the heat and pressure applying apparatus, the moving surface of the discharge conveyor extending generally in said second transverse direction and disposed substantially in vertical alignment with the moving surface of the feed conveyor.

60. The machine according to claim 59 and comprising means for resiliently supporting the flexible member.

61. Conveyor apparatus for changing the direction of travel of generally flat articles comprising, a first conveyor comprising an entrance cylinder, an exit cylinder and a movable conveyor surface extending in a first direction and about the entrance cylinder and the exit cylinders, an engaging surface disposed adjacent and extending generally parallel to the movable conveyor surface, the movable conveyor surface cooperating with the engaging surface to engage articles disposed therebetween and to move articles engaged therebetween upon movement of the movable surface, the engaging surface including an entrance portion forming an entrance nip with the portion of the movable surface extending about the entrance cylinder, the entrance nip facing in a direction transverse to the first direction, and an exit portion forming an exit nip with the portion of the movable surface extending about the exit cylinder, the exit nip facing in a direction transverse to the first direction, the first conveyor surface and the engaging surface being mounted in respective frames, and means for pivoting at least one of the frames so that the conveyor and engaging surfaces can be moved into and out of an adjacent disposition in which an article can be engaged between the movable surface and the engaging surface.

62. Apparatus for cleaning a moving surface comprising a first doctor blade having a blade edge and a second doctor blade having a blade edge, means for supporting the second doctor blade with its blade edge extending transversely of the direction of movement of the moving surface adapted to doctor the moving surface at a first location, and means for supporting the first doctor blade with its blade edge extending transversely of the direction of movement of the moving surface adapted to doctor the moving surface at a second location upstream of and adjacent to the first location, the means for supporting the first doctor blade enabling the first doctor blade to be moved relatively easily relative to the moving surface and the second doctor blade while the second doctor blade remains unmoved with its edge doctoring the moving surface at said first location.

63. The apparatus according to claim 62 wherein the edges of the first and second blades are parallel and extend axially along the circumference of a cylinder.

64. The apparatus according to claim 62 wherein the first doctor blade is supported by the second doctor blade, the means for supporting the first doctor blade comprising cooperating structure on the two blades.

65. The apparatus according to claim 64 wherein the second doctor blade includes at least one slot therein spaced from the blade edge and the first doctor blade includes a depending portion spaced from the blade edge removably received in the slot.

66. The apparatus according to claim 65 wherein the slot extends for the length of the second doctor blade parallel to the edge thereof and the depending portion of the first doctor blade extends for the length thereof parallel to the edge thereof.

67. The apparatus according to claim 65 or 66 wherein the slot and depending portion include interlocking structure such that the first doctor blade can only be moved in a direction parallel to the blade edges.

68. The apparatus according to claim 67 wherein the first doctor blade carries means for cleaning the second doctor blade as the first doctor blade is moved in said direction.

69. The apparatus according to claim 62 wherein the second doctor blade extends transversely of the first doctor blade, the apparatus being adapted to be disposed between two cylinders to bridge the distance therebetween.

70. The apparatus according to claim 64 and comprising means stationarily disposed adjacent to the first doctor blade to clean it as it is moved relative to the second doctor blade.

* * * * *